US007495376B2

(12) United States Patent
Matsubayashi et al.

(10) Patent No.: US 7,495,376 B2
(45) Date of Patent: Feb. 24, 2009

(54) LIGHT SOURCE DEVICE, LIGHTING DEVICE, AND LIQUID CRYSTAL DISPLAY DEVICE

(75) Inventors: Yoko Matsubayashi, Nara (JP); Shinichiro Hataoka, Osaka (JP); Masaki Hirohashi, Kyoto (JP); Nobuhiro Shimizu, Nara (JP); Norikazu Yamamoto, Kyoto (JP); Teruaki Shigeta, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 10/582,224

(22) PCT Filed: Dec. 9, 2004

(86) PCT No.: PCT/JP2004/018406

§ 371 (c)(1),
(2), (4) Date: Apr. 20, 2007

(87) PCT Pub. No.: WO2005/057611

PCT Pub. Date: Jun. 23, 2005

(65) Prior Publication Data

US 2007/0274078 A1 Nov. 29, 2007

(30) Foreign Application Priority Data

| | | |
|---|---|---|
| Dec. 9, 2003 | (JP) | 2003-410065 |
| Jul. 29, 2004 | (JP) | 2004-221311 |
| Aug. 5, 2004 | (JP) | 2004-229210 |

(51) Int. Cl.
*H01J 1/88* (2006.01)
*H01J 11/00* (2006.01)

(52) U.S. Cl. ..... 313/243; 313/238; 313/607

(58) Field of Classification Search ..... 313/238, 313/243, 268, 607, 608
See application file for complete search history.

(56) References Cited

U.S. PATENT DOCUMENTS

| | | | | |
|---|---|---|---|---|
| 5,869,931 | A * | 2/1999 | Terada | 313/607 |
| 5,932,960 | A * | 8/1999 | Terada et al. | 313/485 |
| 6,194,821 | B1 | 2/2001 | Nakamura | |
| 6,304,028 | B1 * | 10/2001 | Vollkommer et al. | 313/491 |
| 6,331,064 | B1 * | 12/2001 | Nishiyama et al. | 362/260 |
| 6,806,647 | B2 * | 10/2004 | Yamamoto et al. | 313/607 |
| 7,276,851 | B2 * | 10/2007 | Tanabe et al. | 313/607 |
| 2001/0050735 | A1 | 12/2001 | Yajima et al. | |
| 2002/0027774 | A1 | 3/2002 | Nishiyama et al. | |
| 2003/0052611 | A1 * | 3/2003 | Yamamoto et al. | 313/637 |
| 2005/0253520 | A1 * | 11/2005 | Tanabe et al. | 313/607 |
| 2006/0139934 | A1 * | 6/2006 | Hirohashi et al. | 362/362 |

FOREIGN PATENT DOCUMENTS

| | | |
|---|---|---|
| EP | 948030 | 10/1999 |
| JP | 5-29085 | 2/1993 |

(Continued)

*Primary Examiner*—Peter Macchiarolo
(74) *Attorney, Agent, or Firm*—Wenderoth, Lind & Ponack, L.L.P.

(57) ABSTRACT

A light source device has an internal electrode (24) disposed at an end portion inside a bulb (23), and an external electrode (25) disposed outside the bulb (23). A holder member (27) holds the external electrode (25) so as to be opposed to the bulb (23) with a predetermined spacing (26). A dielectric member (30) is disposed outside the bulb (23), at a position corresponding to the internal electrode (24) so as to be interposed between the bulb (23) and the external electrode (25).

18 Claims, 41 Drawing Sheets

FOREIGN PATENT DOCUMENTS

| | | |
|---|---|---|
| JP | 5-190150 | 7/1993 |
| JP | 10-64478 | 3/1998 |
| JP | 10-188908 | 7/1998 |
| JP | 11-86797 | 3/1999 |
| JP | 11-329365 | 11/1999 |
| JP | 2000-162593 | 6/2000 |
| JP | 2003-277056 | 10/2000 |
| JP | 2000-311659 | 11/2000 |
| JP | 2001-196028 | 7/2001 |
| JP | 2002-82327 | 3/2002 |
| JP | 2002-184360 | 6/2002 |
| JP | 2003-178717 | 6/2003 |
| JP | 2003-317669 | 11/2003 |
| WO | 03/090252 | 10/2003 |

* cited by examiner

| DIMMING RATIO [%] | | | | |
|---|---|---|---|---|
| 100 | ○ | ○ | ○ | ○ |
| 50 | ○ | ○ | × | ○ |
| 20 | ○ | ○ | × | ○ |
| 10 | ○ | ○ | × | ○ |
| 5 | ○ | ○ | × | ○ |
| 2 | ○ | ○ | × | ○ |
| 1 | ○ | × | × | ○ |

LIGHT SOURCE DEVICE, LIGHTING DEVICE, AND LIQUID CRYSTAL DISPLAY DEVICE

BACKGROUND OF THE INVENTION

1. Technical Field of the Invention

The present invention relates to a light source device comprising a bulb, a discharge medium sealed inside the bulb, and an electrode for exciting the discharge medium. Further, the present invention relates to a lighting device comprising the light source device, and to a liquid crystal display device comprising the lighting device.

2. Description of the Related Art

Recently, research on a light source device that does not use mercury (mercury-less type) as a lamp or light source device used for a back light device of a liquid crystal display device is actively progressing in addition to research on light source devices that use mercury. The mercury-less type light source device is preferable due to low fluctuation of light emission intensity along with time variation of temperature and in view of environmental concerns.

For example, a mercury-free type light source device shown in FIG. 43 is disclosed in Japanese Patent Application Laid-open Publication No. 5-29085. The light source device comprises a tube-shaped bulb 2 inside which a rare gas 1 is sealed, an internal electrode 3 disposed inside the bulb 2, and an external electrode 4 disposed outside the bulb 2. Further, a fluorescent layer 5 is formed on an inner surface of the bulb 2. The external electrode 4 has a strip-like shape extending parallel with an elongation direction of the bulb or a direction of an axis line L of the bulb 2. The external electrode is formed so as to Closely contact an outer surface of the bulb 2 by applying metal paste on the outer surface of the bulb 2, for example. The internal electrode 3 is electrically connected to a lighting circuit 6, whereas the external electrode 2 is grounded. When a voltage is applied between the internal electrode 3 and external electrode 4 by the lighting circuit 6, dielectric barrier discharge plasmanizes the rare gas so that it emits light.

Even if the external electrode 4 is formed by coating with the metal paste, the external electrode 4 cannot be completely in close contact with the outer surface of the bulb 3. In other words, as shown in FIG. 44, due to various causes, such as manufacturing error, vibration during operation, and the temperature status of the environment, a void or a slight gap 7 is inevitably generated between the external electrode 4 and the bulb 2. If the gap 7 exists, electric power cannot be supplied normally to the bulb 2. This causes instability in the light emission intensity. Further, a dielectric breakdown of an atmospheric gas tends to occur at the gap 7, and gas molecules ionized by the dielectric breakdown can damage the peripheral members. For example, if the atmospheric gas is air, the dielectric breakdown generates ozone which damages the peripheral members.

Even if a chemical method other than deposition is used, such as sputtering or adhesive, or a physical method such as mechanical pressing or a shrink tube is used, it is not possible to completely adhere the external electrode to the outer surface of the bulb. Therefore, a gap between the external electrode and the outer surface of the bulb will inevitably exist, causing unstable emission and dielectric breakdown of the atmospheric gas.

Further, in this type of light source device, it is important that time fluctuations in the light emission intensity, as perceived by humans, i.e., "flicker" be prevented. It is also important that the emission intensity be stabilized and dielectric breakdown of the atmospheric gas be prevented.

SUMMARY OF THE INVENTION

An object of this invention is to provide a high reliable light source device having stable light emission intensity and able to prevent dielectric breakdown of atmospheric gas, and which moreover can eliminate flicker.

A first aspect of the present invention provides a light source device, comprising, a bulb inside which a discharge medium is sealed, an internal electrode disposed at an end portion inside the bulb, an external electrode disposed outside the bulb, a dielectric member disposed in the vicinity of the internal electrode so as to be interposed between the bulb and the external electrode at a portion in an elongation direction of the bulb, and a holder member holding the external electrode so that remaining portion of the bulb other than the portion where the dielectric member exists and the external electrode are opposed to each other with a predetermined distance of a space.

The cross-section of the dielectric member, which is perpendicular to an axis line of the bulb, has a shape such as a plate-like shape or a U-like shape.

When a voltage is applied between the internal electrode and external electrode, a dielectric barrier discharge is generated, which excites the discharge medium. The excited discharge medium emits ultraviolet light in the event of transitions to the ground state. The ultraviolet light causes a light to be emitted from the bulb.

The eternal electrode is opposed to the bulb with a predetermined distance of the space by the holder member. In other words, the space is intentionally created between the bulb and the external electrode. The presence of the space achieves stable light emission of the light source device and prevents dielectric breakdown of an atmospheric gas, which results in a highly reliable light source device.

If the external electrode was merely opposed to the bulb with the space, contracted discharge would occur in the vicinity of the internal electrode inside the bulb, and the position and shape of the contracted discharge would fluctuate with time. This time fluctuation of the contracted discharge causes "flickering", i.e., fluctuations with time in emission intensity as perceived by the human eye. In this invention, the dielectric member is disposed outside of the bulb at the position corresponding to the internal electrode so as to be interposed between the bulb and the external electrode. By providing the dielectric member, a capacitance is partially increased at the position corresponding to the internal electrode, which results in the contracted discharge being drawn to a vessel wall of the bulb. As a result, the contracted discharge is fixed, or the time fluctuation of the contracted discharge is greatly reduced, thereby eliminating the flicker.

In order to reliably prevent dielectric breakdown of the atmospheric gas, it is preferable that the distance of the space between the external electrode and the bulb is not less than a shortest distance defined by the following equation.

$$XL = \frac{V}{E0} - \frac{\varepsilon a}{\varepsilon g} \times tg$$

X1L: shortest distance

E0: dielectric breakdown voltage

V: input voltage

∈a: relative permittivity of air

∈g: relative permittivity of a vessel wall of the bulb tg: thickness of the vessel wall of the bulb.

As described above, the dielectric member functions to partially increase the capacitance so as to fix the contracted discharge. Thus, the dielectric member needs to be provided at the portion where the contracted discharge potentially occurs.

Specifically, the internal electrode comprises a primal end positioned on an end portion side of the bulb, and a distal end positioned on a center portion side of the bulb relative to the proximal end. A dimension of the dielectric member in an elongation direction of the bulb and a position of the dielectric member in the elongation direction of the bulb are set so that a distal end of an image of the internal electrode projected onto the external electrode is positioned on the dielectric member.

More specifically, the dielectric member comprises a primal end positioned on the end portion side of the bulb, and a distal end positioned on the center portion side of the bulb relative to the proximal end. The proximal end of the dielectric member is positioned on the end portion side of the bulb relative to the distal end of the internal electrode, and the distal end of the dielectric member is positioned on the center portion side of the bulb relative to the distal end of the internal electrode.

In order to prevent dielectric the breakdown of the atmospheric gas, it is also preferable that the dielectric member is disposed so as to be in contact with an outer surface of the bulb as well as with the external electrode.

For example, the dielectric member may comprise only dielectric material.

In this case, it is preferable that the dielectric member is provided at a portion of an outer periphery of the bulb as viewed in the elongation direction of the bulb. The capacitance is partially increased on the periphery of the bulb, which results in the contracted discharge being reliably fixed.

In order to reliably fix the contracted discharge, it is preferable that the relative permittivity of the dielectric material is not less than 4.7.

As an alternative of the dielectric material, the dielectric member may comprise a dielectric portion made of a dielectric material, and a conductive portion made of a conductive material.

In order to enhance light-extraction efficiency from the bulb, it is preferable that the dielectric member has high transparency. In general, the higher the transparency of dielectric materials, the lower is the relative permittivity. Thus, in a case where the dielectric member comprises only dielectric material, if a dielectric material with high transparency is used in order to improve the light action efficiency, the effect of partially raising the capacitance through provision of the dielectric member is reduced, resulting in the contracted discharge not being stably fixed. On the other hand, the dielectric member comprising the dielectric portion and the conductive portion achieves an increased capacitance due to the provision of the conductive portion. Thus, the capacitance of the dielectric member can be increased without lowering the light-extraction efficiency. In other words, both high light-extraction efficiency and prevention of flicker due to fixation of contracted discharge can be satisfied.

The conductive portion is made of a conductive metal such as an aluminum.

In this case also, it is preferable that the dielectric member is provided at a portion of an outer periphery of the bulb as viewed in the elongation direction of the bulb.

Specifically, the conductive portion is disposed inside the dielectric portion.

More specifically, the dielectric portion comprises a first dielectric layer positioned on the side of the bulb and a second dielectric layer positioned on the side of the external electrode. Further, the conductive portion comprises a conductive layer disposed between the first dielectric layer and the second dielectric layer.

In an alternative method, the conductive layer comprises a sheet-shaped member formed of a conductive material. The conductive layer may also be a mesh-shape member formed of a conductive material. Also, the conductive portion may be an elongated member embedded in the dielectric portion. Alternatively, the conductive layer is a sheet member made of the conductive material. Further, the conductive layer may be a mesh member made of a conductive material. Furthermore, the conductive portion may be an elongated member embedded in the dielectric portion.

The light source device may further comprise a conductive member disposed within the bulb at a position corresponding to the internal electrode and the dielectric member. The provision of the conductive member can achieve more stable fixation of the contracted discharge. This is inferred to occur because the contracted discharge passes through the dielectric member.

In order to stably fix the contracted discharge, it is preferable that the conductive member is positioned so as to overlap the dielectric member. Specifically, the conductive member comprises a proximal end positioned on the end portion side of the bulb, and a distal end positioned on the center portion side of the bulb relative to the proximal end portion. A dimension of the conductive member in an elongated direction of the bulb and a position of the conductive member in the elongation direction of the bulb are set so that a distal end of an image of the conductive member projected onto the external electrode is positioned on the dielectric member.

Further, the conductive member is provided at a portion of the bulb as viewed in the elongation direction of the bulb.

A second aspect of the present invention provides a lighting device comprising the above-mentioned light source device, and a light guide plate having a light incidence surface and a light emission surface and guiding a light emitted from the light source device from the light incidence face to the light emission face for emission.

A third aspect of the present invention provides a liquid crystal display device comprising the above-mentioned lighting device, and a liquid crystal display panel disposed so as to be opposed to the light emission surface of the light guide plate.

In a light source device of this invention, the external electrode disposed outside of the bulb is held by the holder member so as to be opposed to the bulb with the predetermined distance of the space. Further, the light source device comprises a dielectric member disposed outside of the bulb and corresponding to the internal electrode. Thus, the light emission intensity is stable and dielectric breakdown of the atmospheric gas can be prevented, and in addition flicker can be reduced. Therefore, both the stable light emission intensity and prevention of the dielectric breakdown of the atmospheric gas can be achieved without the flicker.

DESCRIPTION OF THE REFERENCE NUMERALS

Figure 1:
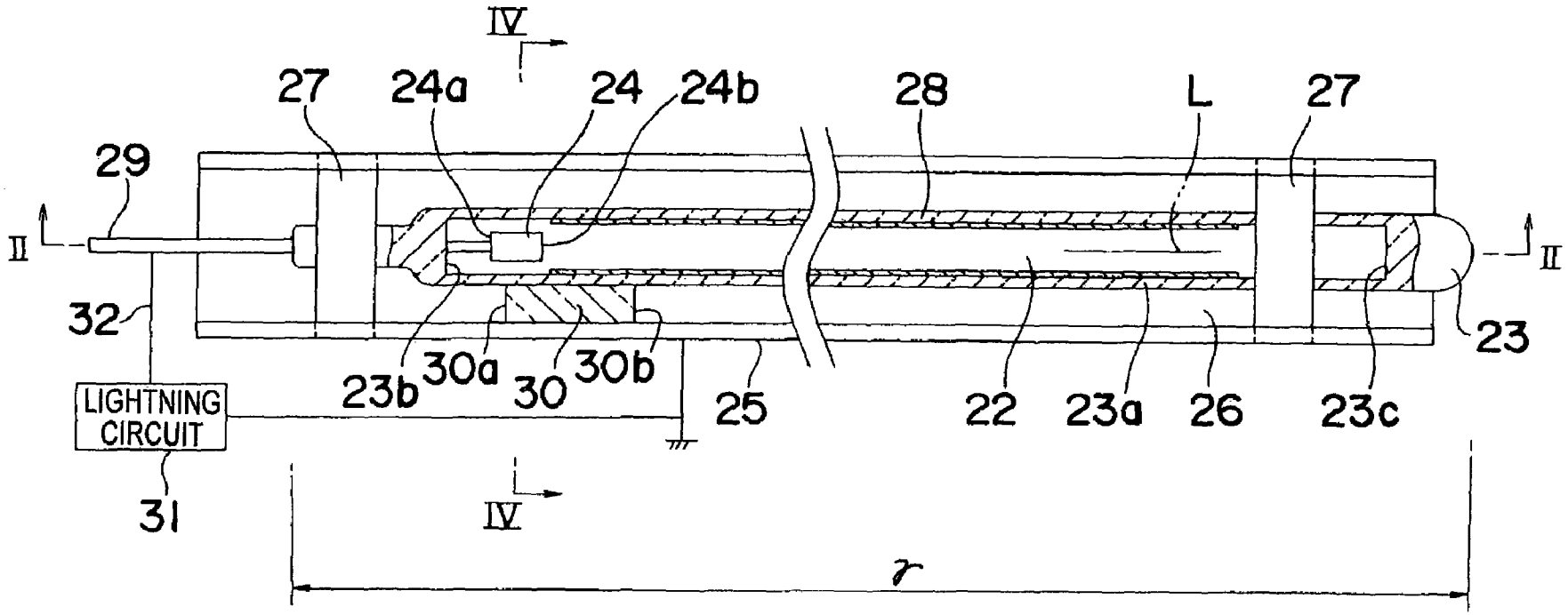
FIG. 1 is a plan view depicting a light source device according to a first embodiment of the present invention.
Figure 2:
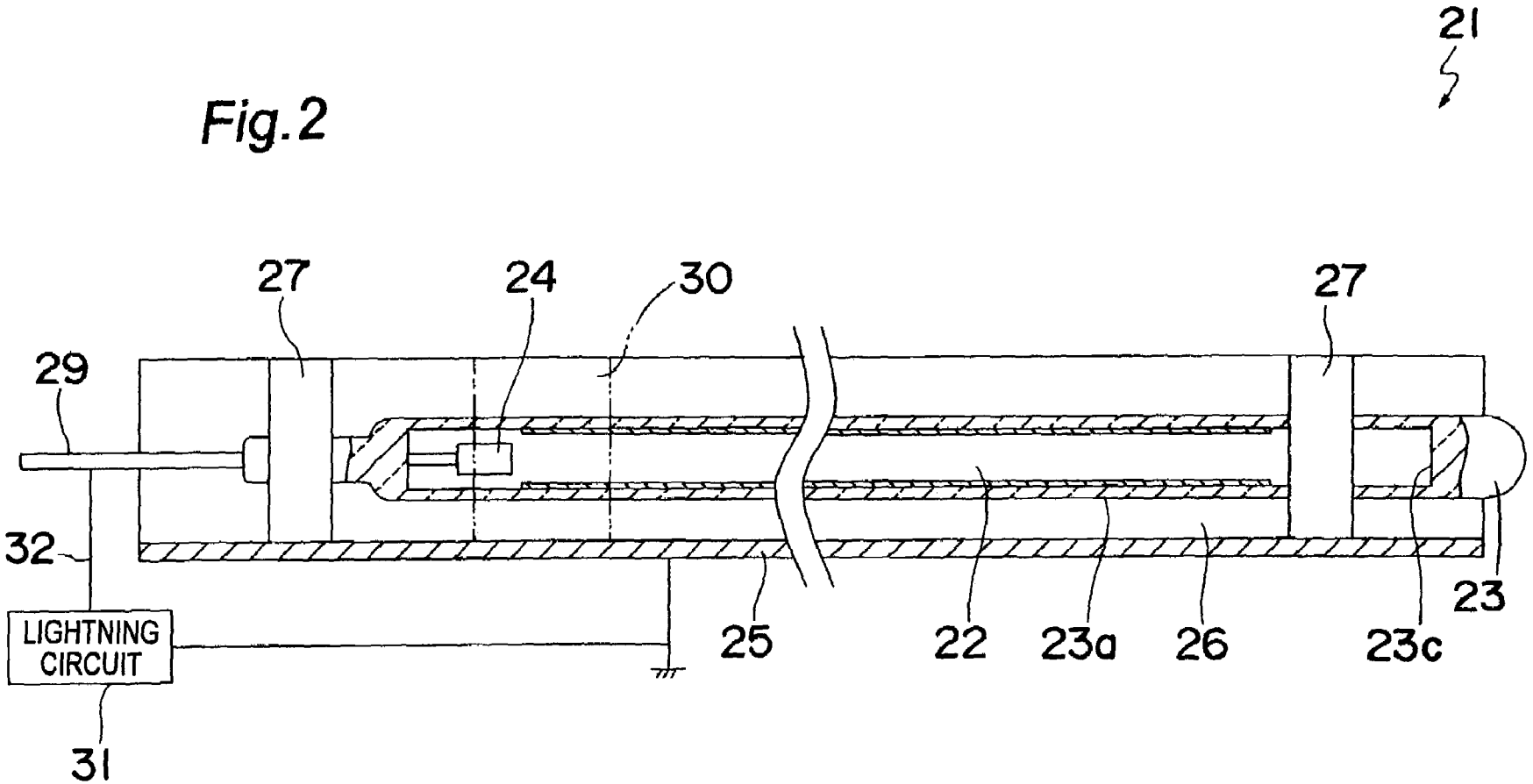
FIG. 2 is a cross-sectional view taken along a line II-II in FIG. 1.

21: light source device
22: discharge space
23: bulb
24: internal electrode
25: external electrode
26: space
27: holder member
28: fluorescent layer
30: dielectric member
51: first dielectric layer
52: second dielectric layer
53: dielectric portion
54: conductive layer
56: mesh layer
58: rod member
61: wire member
70: conductive member
151: liquid crystal display device
153: back light device

DETAILED DESCRIPTION OF THE INVENTION

First Embodiment

FIGS. 1 to 20 show a lamp or light source device 21 according to a first embodiment of the present invention. The light source device 21 comprises a air tight vessel or bulb 23 an inside of which functions as a discharge space 22, a discharge medium (not shown) sealed inside the bulb 23, an internal electrode 24, and an external electrode 25. The light source device 21 further comprises two holder members 27 for holding the external electrode 25 so that the external electrode 25 is opposed to the bulb 23 with a predetermined distance ta of a space 26 therebetween as described below. The light source device 21 comprises a dielectric member 30 disposed outside the bulb 23 at a position corresponding to the internal electrode 24 so as to be interposed between the bulb 23 and the external electrode 25. The light source device 21 further comprises a lighting circuit 31 for applying high frequency voltage to the discharge medium.

Figure 3:
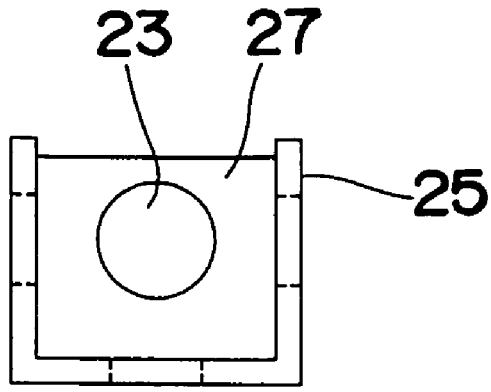
FIG. 3 is a right side view depicting the light source device according to the first embodiment of the invention.
Figure 5:
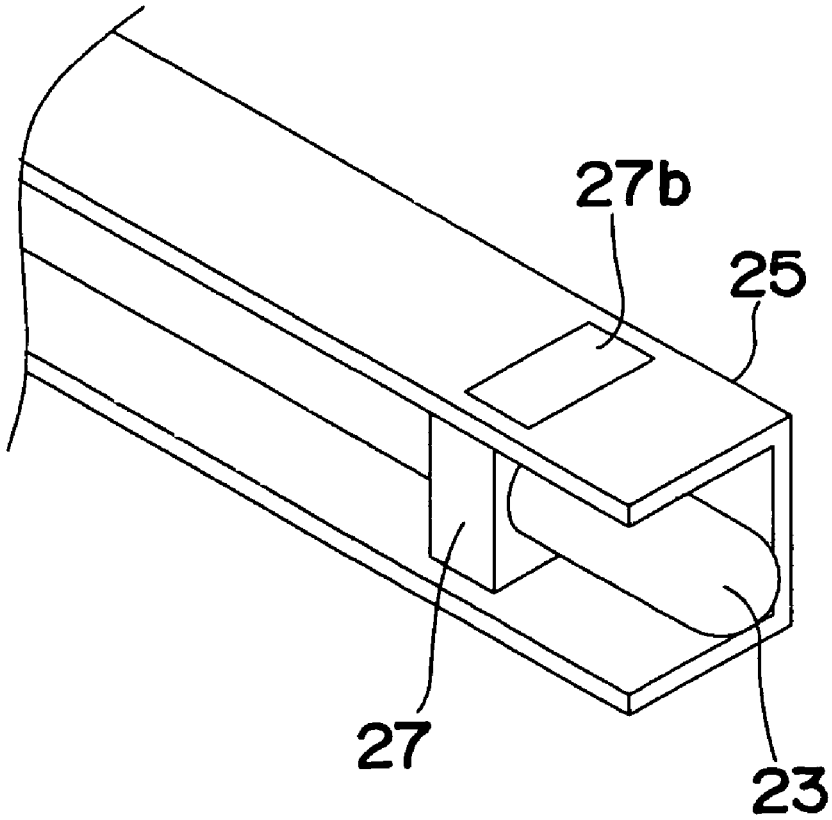
FIG. 5 is a partial enlarged perspective view of the light source device according to the first embodiment of the invention.
Figure 4:
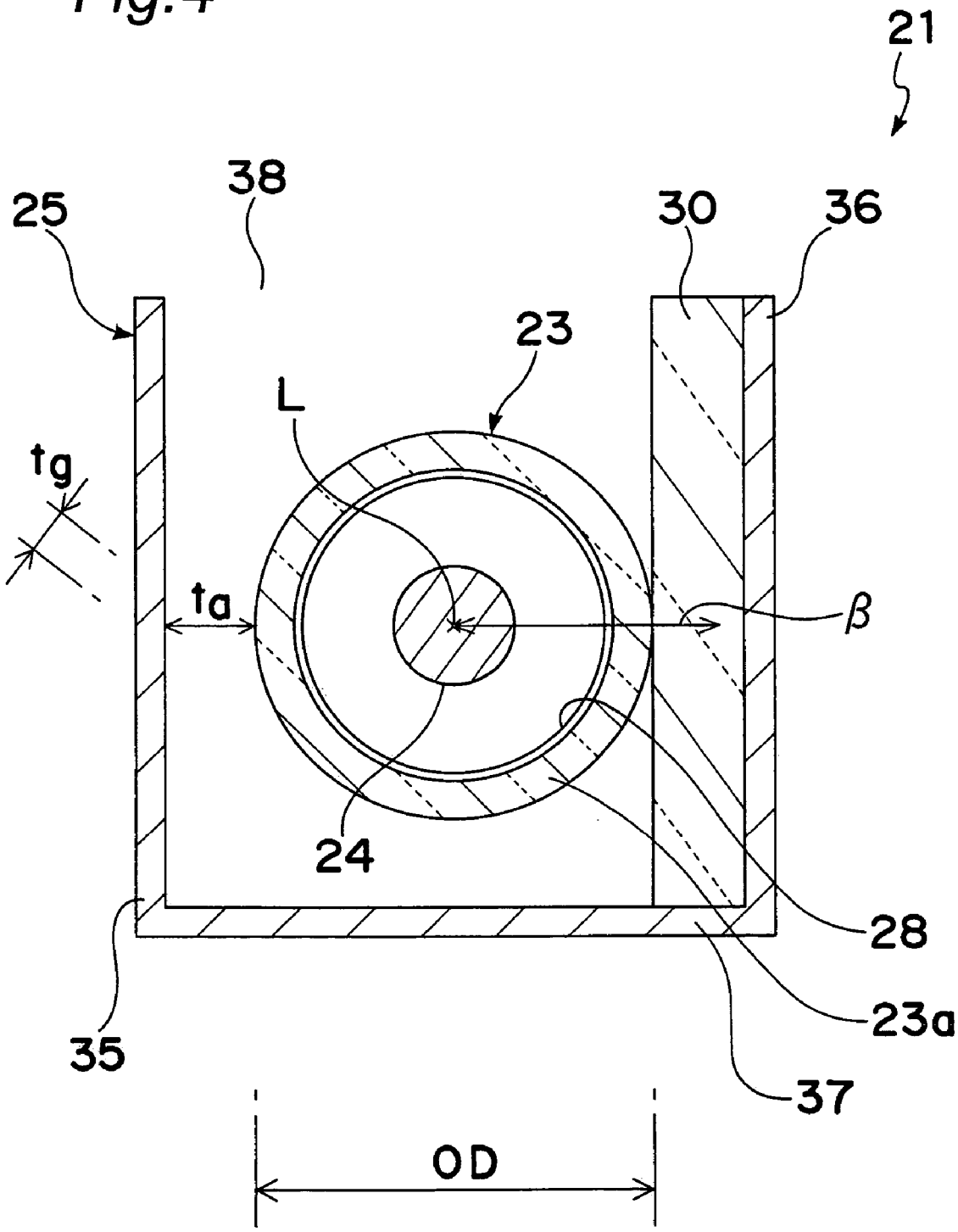
FIG. 4 is a schematic enlarged cross sectional view taken along a line IV-IV in FIG. 1.

The bulb 23 has an elongated straight tubular shape. As shown in FIGS. 3 and 4, a cross-section of the bulb 23, perpendicular to an elongation direction of the bulb 23 or an axis line L, has a circular shape. The cross-sectional shape of the bulb 23, however, may be another shape, such as an ellipse, triangle and square. The bulb 23 need not have an elongated shape. The bulb 23 may have a shape other than straight tubular, such as an L-like shape, a U-like shape or a rectangular shape.

In this embodiment, the bulb 23 is made of a translucent material such as a borosilicate glass. The airtight container 10 may be made of glass such as quartz glass, soda glass and lead glass, or organic matter such as acrylic.

An outer diameter of the glass tube used as the bulb 23 normally ranges from approximately 1.0 mm to 10 mm, but is not limited to this range. For example, a glass tube having an outer diameter of approximately 30 mm, used for fluorescent lamps for generic illumination, may be employed. A distance from the outer surface to the inner surface of the bulb 23, i.e., a thickness of a vessel wall of the bulb 23, is usually approximately 0.1 mm to 1.0 mm.

The bulb 23 is sealed, and the discharge medium (not illustrated) is sealed in the bulb. The discharge medium is one or more types of gas, mainly rare gas. The discharge medium may comprise mercury, but because the contracted discharge described below occurs more prominently in gases not containing mercury, the advantageous results of this invention appear more prominently when the discharge medium does not contain mercury, that is, when only a rare gas is used. The gas includes xenon, for example. Other rare gases, such as krypton, argon and helium, can be adopted. The discharge medium may contain a plurality of types of these rare gases. A pressure of the discharge medium sealed inside the bulb 23, i.e. an internal pressure of the bulb 23, is approximately 1 kPa to 76 kPa. In this embodiment, a gas mixture of 60% xenon and 40% argon, not containing mercury, is sealed inside the bulb 23 at 20 kPa.

A fluorescent layer 28 is formed on the inner surface of the bulb 23. The fluorescent layer 28 converts a wavelength of light emitted from the discharge medium. Depending on the variation of the material constituting the fluorescent layer 28, lights with various wavelengths, such as white light, red light, and green light, can be acquired. The fluorescent layer 28 can be formed with material used for general-purpose fluorescent lamps and plasma displays.

The internal electrode 24 is disposed at one end portion 23*b* inside the bulb 23. The internal electrode 24 is comprised of metal such as tungsten or nickel. A surface of the internal electrode 24 may be partially or entirely covered by a metal oxide layer such as cesium oxide, barium oxide or strontium oxide. By using such a metal oxide layer, a lighting start voltage can be decreased, and deterioration of the internal electrode by ion impact can be prevented. The surface of the internal electrode 24 may be covered by a dielectric layer (e.g. glass layer). A conductive member 29 has a distal end to which the internal electrode 24 is provided and a primal end disposed outside the bulb 23. The conductive member 29 is electrically connected to the lighting circuit 31 via lead wires 30.

Figure 6A:
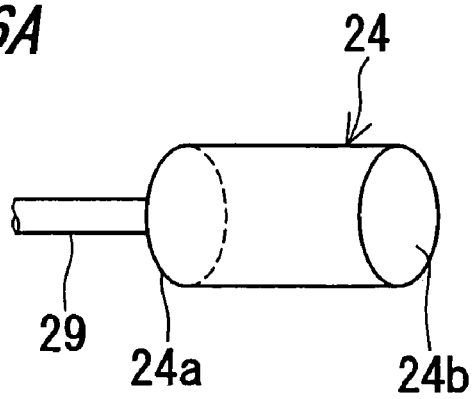
FIG. 6A is a perspective view depicting an internal electrode.
Figure 6B:
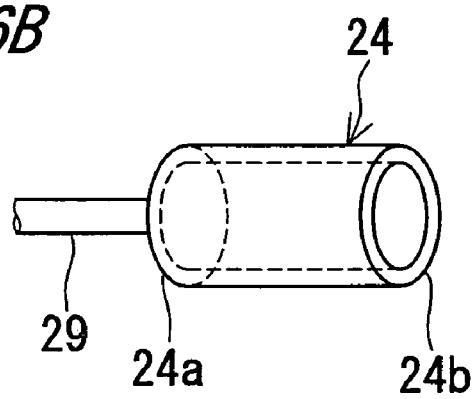
FIG. 6B is a perspective view depicting an alternative of the internal electrode.
Figure 6C:
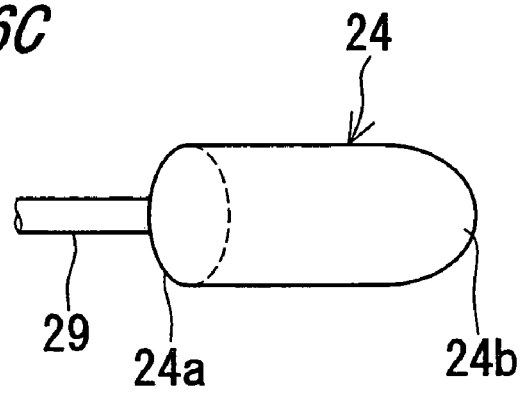
FIG. 6C is a perspective view depicting an alternative of the internal electrode.
Figure 6D:
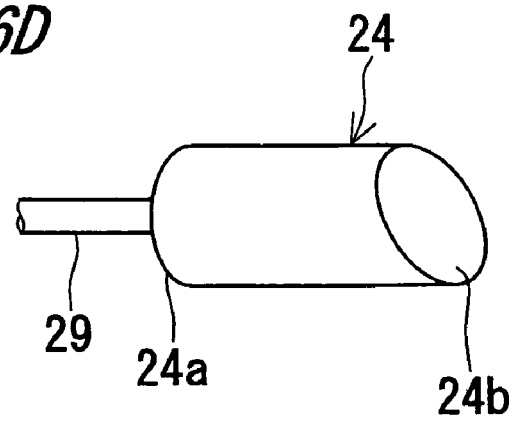
FIG. 6D is a perspective view depicting an alternative of the internal electrode.

With reference to FIG. 6A, the internal electrode 24 in this embodiment has a short circular column shape. At proximal end 24*a* positioned on the end portion 23*b* side of the bulb 23, the above-described conductive member 29 is fixed to the internal electrode 24. On the other hand, a distal end 24*b* of the internal electrode 24 is positioned on a center portion side of the bulb 23 relative to the proximal end 24*a*. The internal electrode 24 may also have a different shape, such as shown in FIG. 6B through FIG. 6D. The internal electrode 24, shown in FIG. 6B, has a cylindrical shape with one closed end. The internal electrode 24 shown in FIG. 6C has a streamlined distal end, and overall has a bullet shape. The internal electrode 24 shown in FIG. 6D is shaped as a short cylinder with an inclined face at the distal end. Among other shapes, a spherical electrode is also preferable.

The external electrode 25 is comprised of conductive material such as metal including copper, aluminum and stainless. Further, the external electrode 25 is ground. As described later in detail, the external electrode 25 may be a transparent conductor of which the main component is tin oxide and indium oxide. In the present embodiment, the external electrode 25 has an elongated shape extending along a direction of the axis line L of the bulb 23. As most clearly shown in FIG. 4, a cross-section of the external electrode 25, perpendicular to the axis line L, has a U-like shape or a square shape of which one side is removed. Specifically, the external electrode 25 comprises a pair of flat first wall sections 35 and 36, and a second wall section 37 which links these first wall sections 35 and 36. The straight tubular bulb 23 is disposed in a space surrounded by these wall sections 35 to 37 of the external electrode 25. Specifically, as most clearly shown in FIG. 4, the first wall sections 35 and 36 are opposed to each other with the bulb 23 being disposed therebetween, and the second wall section 37 is opposed to an open section 38 with the bulb 23 disposed herebetween. If the external electrode 25 is subjected to mirror-surface reflection treatment, then a high emission light quantity from the light source device 21 can be expected, even without providing a high-reflection sheet in the interior of the external electrode 25.

Figure 7:
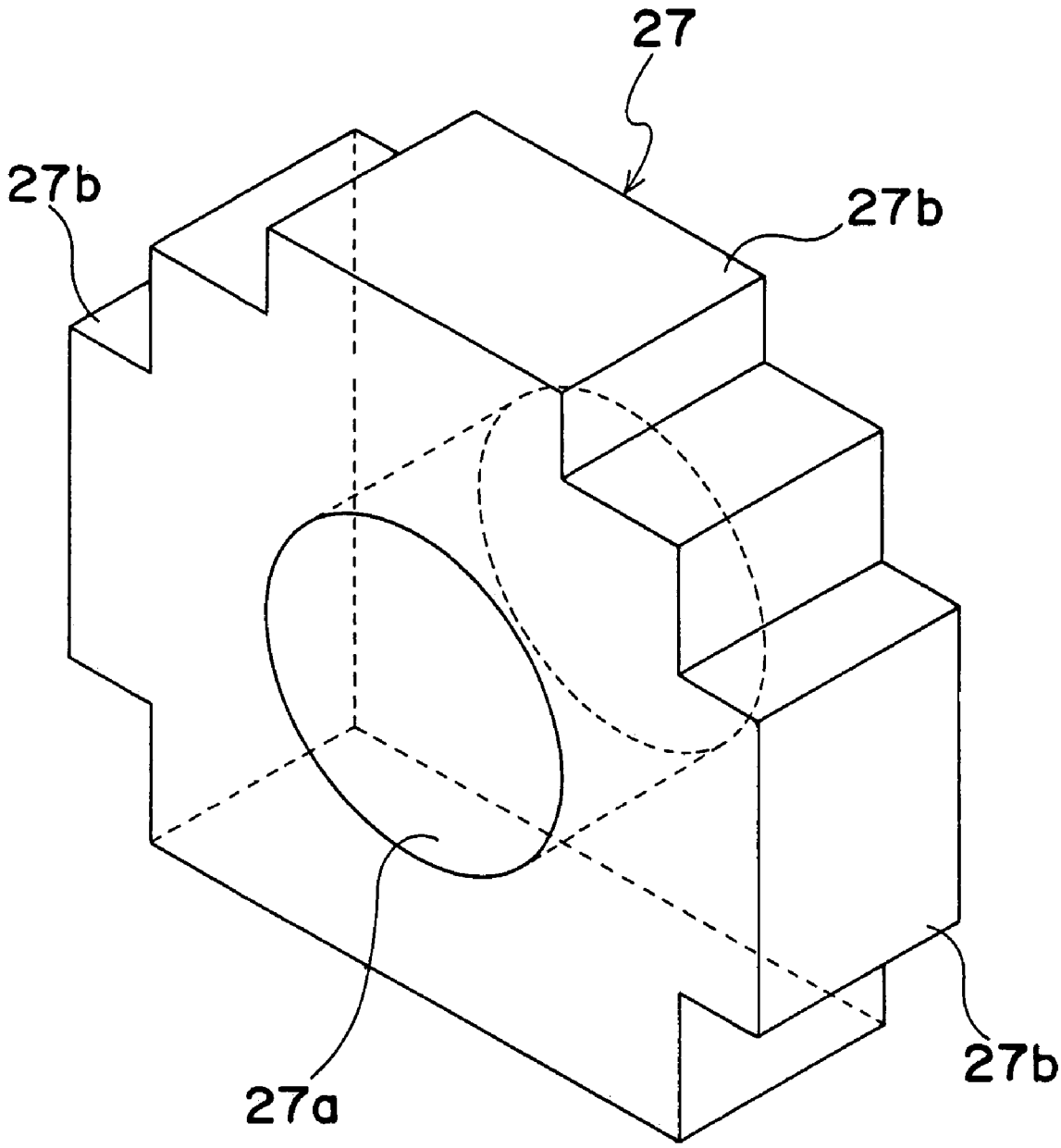
FIG. 7 is a perspective view showing a holder member.

Then, a supporting structure of the external electrode 25 to the bulb 23 will be described. As described above, the external electrode 25 is secured to the bulb 23 by the two holder members 27. The holder member 27 is made of an insulating material having elasticity, such as silicon rubber. As shown in FIG. 7, the holder member 27 is a relatively flat rectangular parallelepiped, wherein a circular support hole 27*a* penetrates at a center of the holder member 27. The bulb 23 is inserted into the support hole 27*a*, and the holder member 27 is secured to the bulb 23 by a hole wall of the support hole 27*a* elastically engaging the outer surface of the bulbs 23. A rectangular parallelepiped engagement protrusion 27*b* is disposed on each of three of four side faces of the holder member 27, excluding one side face corresponding to the open section 35 of the external electrode 25. A regular engagement hole 38 is formed in each of the walls sections 35 to 37, respective, on both ends in the longitudinal direction of the external electrode 25. BY the engagement protrusions 27*b* fitting into the engagement holes 38, the external electrode 25 is secured to the holder member 27. As most clearly shown in FIG. 1, the holder member 27 is disposed at a position away from an area where the discharge space 22 and the external electrode 25 are opposed to each other.

As most clearly shown in FIG. 4, a space 26 is provided between the outer surface of the bulb 23 and the external electrode 25. In other words, the bulb 23 is not in contact with the external electrode 25 throughout the entire axis line L direction.

The dielectric member 30 is composed of a dielectric material such as silicone or glass. As is most clearly shown in FIG. 8, the dielectric member 30 of this embodiment has a flat rectangular parallelepiped shape. The dielectric member 30 will be described latter in detail Then, the reason for holding the bulb 23 by the holder members 27 so that a space 26 is provided between the bulb 23 and the external electrode 25 will be explained. As explained above, no matter what physical method or chemical method is used to cause the external electrode to closely contact the bulb, a gap unavoidably occurs and causes instability in the emission intensity and the dielectric breakdown of the atmospheric gas. In contrast, the present invention entirely changes the concept of the common knowledge accepted by those skilled in the art where the external electrode must be brought into contact with the bulb as closely as possible. Specifically, according to the present invention, the space 26 is intentionally or actively provided between the external electrode 25 and the outer surface of the bulb 23 for intentionally arranging the external electrode 25 and bulb 23 so as to be spatially separated from each other. Consequently, even if slight shifts occur in the position of the external electrode 25 or bulb 23, the effect of such shifts on the space 26 between the eternal electrode 25 and bulb 23 is extremely small. In other words, even if the slight shift occurs in the positions of the external electrode 25 or bulb 23, the external electrode 25 can be maintained reliably in a state of removal from the bulb 23. As a result, the power input to the bulb 23 is stabilized, and the light emission intensity is maintained at an extremely stable level. As explained below, appropriate setting of the distance of the space 26 prevents excessive application of excessive voltage to the space 26 as well as dielectric breakdown of the atmospheric gas filing the space 26, which, in this embodiment, is air.

Referring again to FIGS. 10A and 10B, the space 26 and a vessel wall 23*a* (including the fluorescent 5) exist between the external electrode 25 and the discharge space 22. The space 26 and the vessel wall 23*a* can be regarded as equivalent to the capacitors 41 and 42 connected in series.

With regard to electric charge Q stored in the capacitors 41 and 42, the following equation (1) is established.

$$Q=C0\cdot V=C1\cdot Vg=C2\cdot Vg \tag{1}$$

In this equation, "C1" and "C2" denote the capacitances of the capacitors 41 and 42, "C0" denotes combined capacitance of the capacitors 41 and 42, "Vg" denotes a voltage applied to the vessel wall 23*a*, "Va" denotes a voltage applied to the space 26, and 'V' is a voltage applied between the discharge space 22 and external electrode 25.

Further, a thickness "tg" of the vessel wall 23*a*, a width "ta" of the space 26, the voltage "Vg" applied to the vessel wall 23*a*, the voltage "Va" applied to the space 26, the voltage 'V' applied to the discharge space 22 and external electrode 25, an electric field "Eg" in the vessel wall 23*a*, and an electric field "Ea" in the space 26 have relations defined by following equations (2) to (4).

$$V = Va + Vg \tag{2}$$

$$Ea = \frac{Va}{ta} \tag{3}$$

$$Eg = \frac{Vg}{tg} \tag{4}$$

From the equations (2) to (4), following equation (5) is obtained.

$$Ea = \frac{Va}{ta} = \frac{C1\cdot V}{(C1+C2)\cdot ta} \tag{5}$$

According to the definition of a capacitor, the capacitances C1 and C2 of capacitors 41 and 42 are respectively given by following equation (6).

$$C1 \propto \in g/tg$$

$$C2 \propto \in a/ta \tag{6}$$

By applying the equation (5) to the equation (6), following equation (7) regarding the electric field Ea in the space 26 is obtained.

$$Ea = \frac{\varepsilon g\cdot V}{(\varepsilon g\cdot ta+\varepsilon a\cdot ta)} \tag{7}$$

In the present embodiment, since air that has the dielectric constant of 1 is filled in the space 26, following equation (7)' is established.

$$Ea = \frac{\varepsilon g\cdot V}{(\varepsilon g\cdot ta+tg)} \tag{7'}$$

If the dielectric breakdown electric field of the space 26 is "E0", following equation (8) needs to be established in order to prevent the occurrence of dielectric breakdown in the space 26.

$$E0>Ea \tag{8}$$

By applying the equation (7) to the equation (8), following inequality (9) is obtained.

$$ta > \frac{V}{E0} - \frac{\varepsilon a}{\varepsilon g}\times tg \tag{9}$$

If the space 26 is filled with air (∈1=1), following inequality (9)' is established.

$$ta > \frac{V}{E0} - \frac{tg}{\varepsilon g} \tag{9'}$$

Therefore, in order to prevent the dielectric breakdown in the space 26, the distance "ta" of the space 26 needs to be set to be longer than the shortest distance XL defined by following equation (10).

$$XL = \frac{V}{E0} - \frac{\varepsilon a}{\varepsilon g}\times tg \tag{10}$$

Especially, when the space 26 is filled with air, the shortest distance XL is defined by following equation (10)'.

$$XL = \frac{V}{E0} - \frac{tg}{\varepsilon g} \quad (10)'$$

The distance "ta" of the space 26 set to be longer than the shortest distance XL prevents the dielectric breakdown of the atmospheric gas filled in the space 26 and damages of the peripheral members due to gas molecules ionized by the dielectric breakdown. In the present embodiment, since the atmospheric gas is air, ozone generated by the dielectric breakdown is prevented from causing damage to the peripheral members.

The longest distance of the distance ta of the space 26 can be determined according to a condition where the light source device can be lit by reasonable input power. In other words, if the distance is excessively long, the input power necessary to activate the light source device, should be set excessively high, which is not practical.

If the atmospheric gas occupying the space 26 is air (which has the dielectric constant of 1) as in the present embodiment, it is preferable that the distance "ta" of the space 26 is set to be not less than 0.1 mm and not more than 2.0 mm. The lower limit (0.1 mm) of the distance "ta" is determined by equations (10) and (10)'. For the upper limit of the distance "ta" the maximum voltage between the internal electrode 24 and the external electrode 25 is approximately 5 kV, and the distance "ta" of the space 26 should be set to approximate 2.0 mm at maximum in order that the voltage of approximately 5 kV generates the discharge in the bulb 23.

Figure 11:
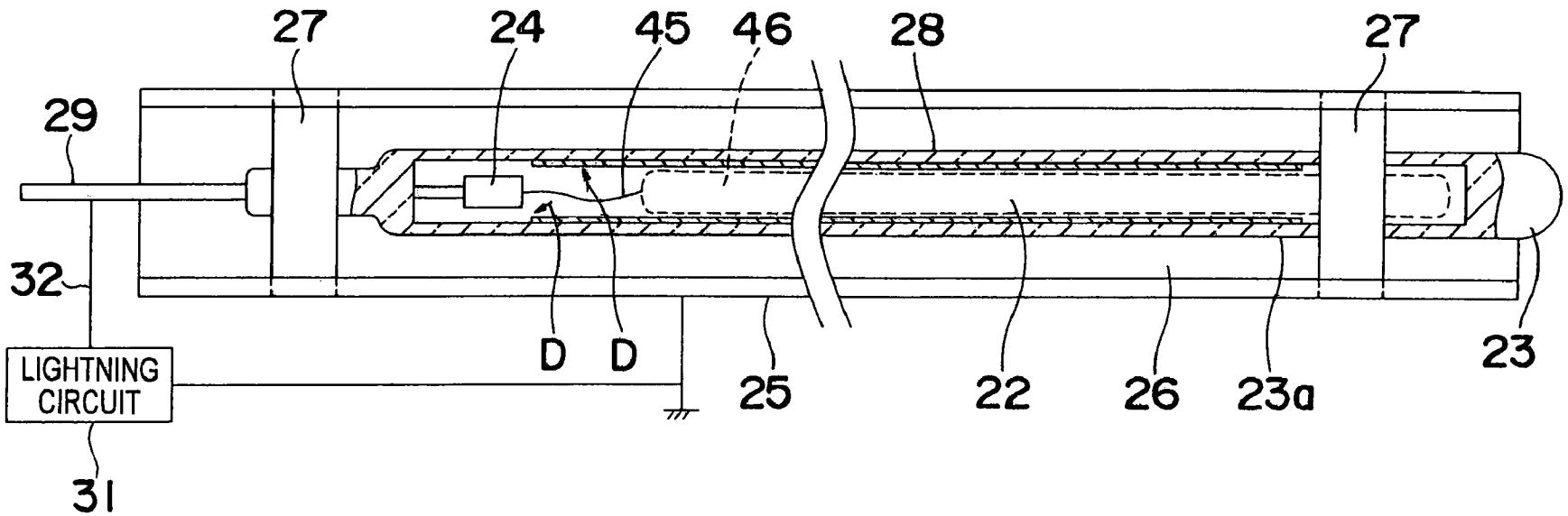
FIG. 11 is a plane view depicting a light source device that has a space between the external electrode and bulb but does not have a dielectric member.

As described above, by holding the bulb 23 by the holder members 27 so that the space 26 is provided between the bulb 23 and the external electrode 25, the emission intensity of the bulb 23 is stabilized, and moreover the dielectric breakdown of the atmospheric gas can be prevented. However, in a light source device as shown in FIG. 11, where the external electrode 25 is merely opposed to the bulb 23 with a space 26 therebetween without providing the dielectric member 30, the contracted discharge occurs in the vicinity of the internal electrode 24 within the bulb 23 and changes especially when the input power is increased, and the position and shape of this contracted discharge fluctuate with time. The time fluctuation of the contracted discharge results in time fluctuation of the emission intensity perceived by humans, i.e., "flicker". In this embodiment, by providing the dielectric member 30, the flicker caused by the time fluctuations of the contracted discharge is reduced. The follow are explanations in this regard.

Figure 12:
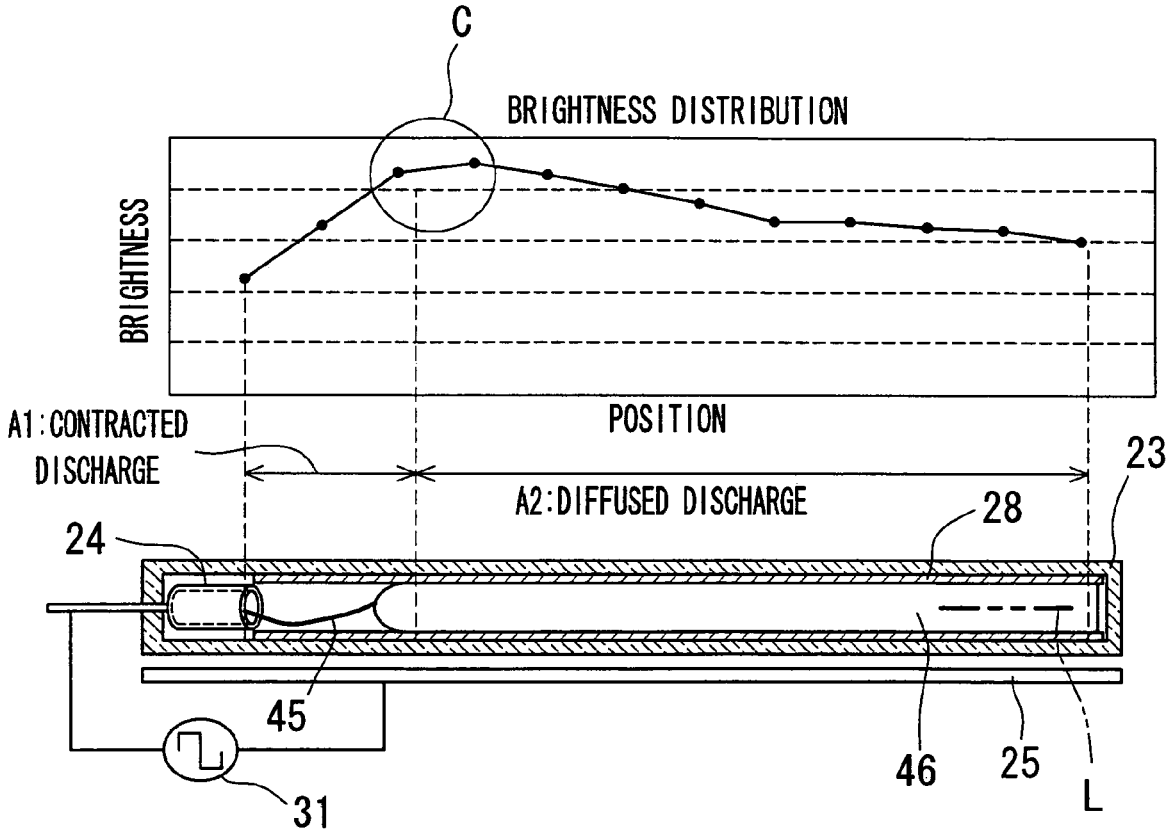
FIG. 12 is a schematic diagram for explaining diffused discharge and contracted discharge.

First, the contracted discharge will be explained. Referring to FIG. 11 and FIG. 12, a discharge having a narrow discharge path in a cross-section perpendicular to the axis line L of the bulb is qualitatively classified as the contracted discharge as indicated by reference numeral "45". On the other hand, as indicated by reference numeral "46", a discharge having a wide discharge path diffuses the whole discharge space 22 in the cross-section perpendicular to the axis line L of the bulb and is referred to as the discharge. The flicker occurs due to the time fluctuations in configuration and shape of the contracted discharge 45 as indicated by arrows "D" in FIG. 11. In this specification, a quantitative distinction is made between the contacted discharge 45 and diffused discharge 46. Referring to FIG. 12, brightness distribution in a direction of the axis line L of the bulb 23 comprises an area A1 in which the brightness rises from low brightness to high brightness from the end portion 23*b* on the side of the internal electrode 24 toward the other end portion 23*c*, and an area A2 in which the brightness declines from high brightness to low brightness. The discharge in the area A1 in which the brightness rises from low brightness to high brightness is taken to be the contracted discharge 45, while the discharge in the area A2 in which brightness declines from high brightness to low brightness is taken to be the diffused discharge 46. When the distance of the contracted brightness 45 is short, i.e., when the area A1 is short, an area in the vicinity of a maximum value of the brightness, indicated by the symbol C, is positioned close to the internal electrode 24.

Figure 13A:
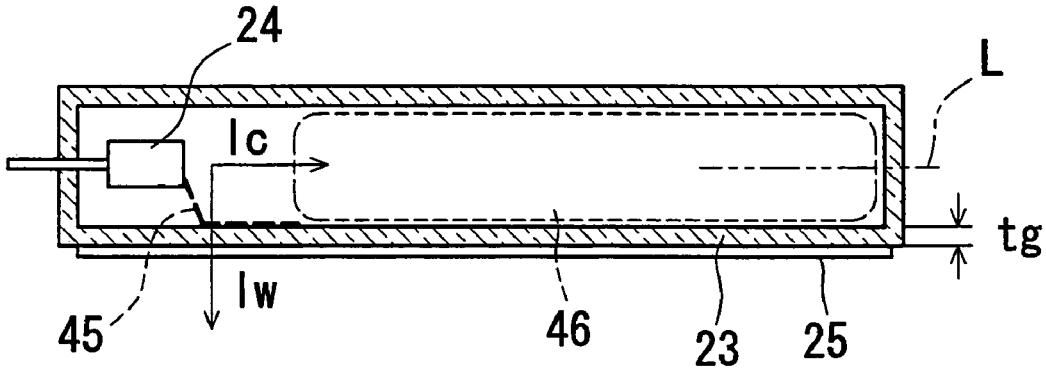
FIG. 13A is a schematic diagram explaining a current flow in the bulb when the external electrode is in contact with an outer surface of the bulb.
Figure 13B:
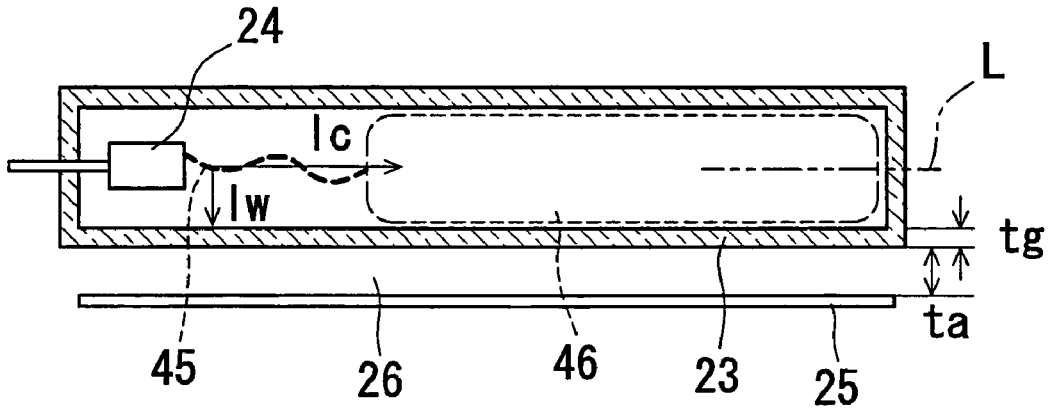
FIG. 13B is a schematic diagram for explaining a current flow in the bulb when the between the external electrode and the bulb is provided, but no dielectric member is provided.

The following is an explanation of the reason why time fluctuations of the contracted discharge 46 are more remarkable and consequently flicker occurs more readily when the external electrode 25 is disposed so as to be spaced from the bulb 23, as opposed to when the external electrode 25 is disposed so as to be in contact with the bulb 23. FIG. 13A shows a light source device in which the external electrode 25 is in contact with the outer surface of the bulb 23. FIG. 13B shows a light source device in which the space 26 is provided between the external electrode 25 and the bulb 23. A current flowing in the vicinity of the internal electrode 24 in the discharge space 22 can be divided into a current Ic which flows along the axis line L toward the center portion of the bulb 23, and a current Iw which flows in a direction perpendicular to the axis line L toward the vessel wall 23*a* of the bulb 23. In the case where the external electrode 25 is in contact with the bulb 23 as shown in FIG. 13A, the following equation (11) is obtained from the above equation (6). Here, "C1" denotes the capacitance of the vessel wall 23*a* of the bulb 23, "∈g2" denotes the relative permittivity of the vessel wall 23*a*, and "tg" denotes thickness of the vessel wall 23*a*.

$$Iw \propto C1 \propto \in g/tg \quad (11)$$

Similarly, in case that the space 26 is provided between the external electrode 25 and bulb 23 as shown in FIG. 13B, the following equation (12) is obtained for the current Iw. "C0" denotes the combined capacitance of the bulb 23*a* and space 26 (see FIG. 10B), "∈a" denotes the relative permittivity of the space 26, and "ta" denotes thickness of the space 26.

$$Iw \propto C0 \propto \frac{\left(\frac{\varepsilon g}{tg}\right) \times \left(\frac{\varepsilon a}{ta}\right)}{\left(\frac{\varepsilon g}{tg}\right) + \left(\frac{\varepsilon a}{ta}\right)} \quad (12)$$

If ∈g=5, ∈a=1, tg=0.3, and ta=0.5, then the constant of proportionality of the current Iw for the case of FIG. 13A is 16.7 from equation (11) whereas the constant of proportionality of the current Iw for the case of FIG. 13B is 1.8. This means when the space 26 is provided between the external electrode 25 and the bulb 23, the current Iw flowing toward the vessel wall 23*a* of the bulb 23 is small with respect to the current Ic flowing toward the center of the bulb 23, compared with the case where the external electrode 25 is in contact with the bulb 23. Thus, when the space 26 is provided between the external electrode 25 and the bulb 23, the contracted current 45 flows in the vicinity of a center portion of the cross-section that is perpendicular to the axis line L of the bulb 23 in the discharge space 22. Consequently, the time fluctuations in the configuration and position of the contracted current 45 due to convection flows and resistances of the discharge gas become prominent, resulting in the occurrence of flickering.

Figure 13C:
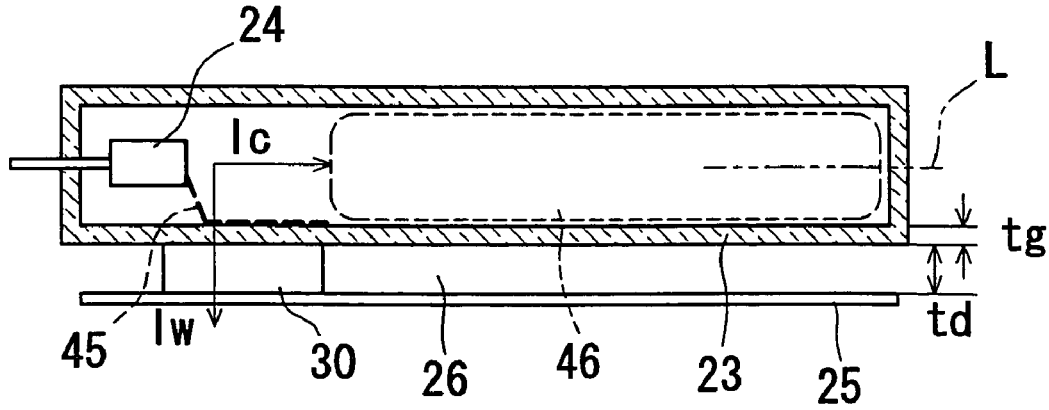
FIG. 13C is a schematic diagram for explaining the current flow in the bulb of the light source device of the first embodiment.

Then, following explanation is a reason that the time fluctuation of the contracted discharge 45 can be inhibited so as to reduce the flicker by providing the dielectric member 30 even when the space 26 is provided between the external electrode 25 and bulb 23. FIG. 13C shows in summary a light source device which is the light source device 21 of the first embodiment, that is, having a space 26 between the external electrode 25 and bulb 23, and also comprising a dielectric member 30.

If the capacitance of the vessel wall 23*a* is "C1" and the capacitance of the dielectric member 30 is "C3", then the combined capacitance "C4" is given by equation (13) listed below.

$$C4 = \frac{C1 \times C3}{C1 + C3} \tag{14}$$

If the relative permittivity of the dielectric member 30 is denoted by "∈d" and the thickness is denoted by "td", then the following equation (15) is established regarding the capacitance "C3".

$$C3 \propto \in d/td \tag{15}$$

From the equations (14) and (15), the following equation (16) is obtained.

$$Iw \propto C4 \propto \frac{(\varepsilon g/tg) \times (\varepsilon a/ta)}{(\varepsilon g/tg) + (\varepsilon a/ta)} \tag{16}$$

As described above, if ∈g=5, ∈a=1, tg=0.3, ta=0.5, and in addition ∈d=5 and td=0.5, then from the equation (16) the constant of proportionality of the current Iw for the case of FIG. 13C (this embodiment) is 6.3. This means that compared with the case of FIG. 13B where the dielectric member 30 is not employed, the current Iw flowing toward the vessel wall 23*a* of the bulb 23 is increased by providing the dielectric member 30. Thus, the contracted discharge 45 is drawn toward the vessel wall 23*a* of the bulb 23. As a result, the contracted discharge 45 is fixed in place, or the time fluctuations in the contracted discharge 45 are greater reduced, resulting in elimination of the flicker.

The dielectric member 30 will now be explained in detail. First, as explained above, the capacitance is partially increased by providing the dielectric member 30, resulting in the contracted discharge 45 being drawn toward the vessel wall 23*a* of the bulb 23. Thus, the dielectric member 30 needs to be provided in the portion where the contracted discharge 45 occurs. As explained above, the contracted discharge 45 occurs in the vicinity of the internal electrode 24. Therefore, the dielectric member 30 needs to be provided at a position not at the center portion of the bulb 23, but at a position near the internal electrode 24 or corresponding to the internal electrode 24.

Figure 8:
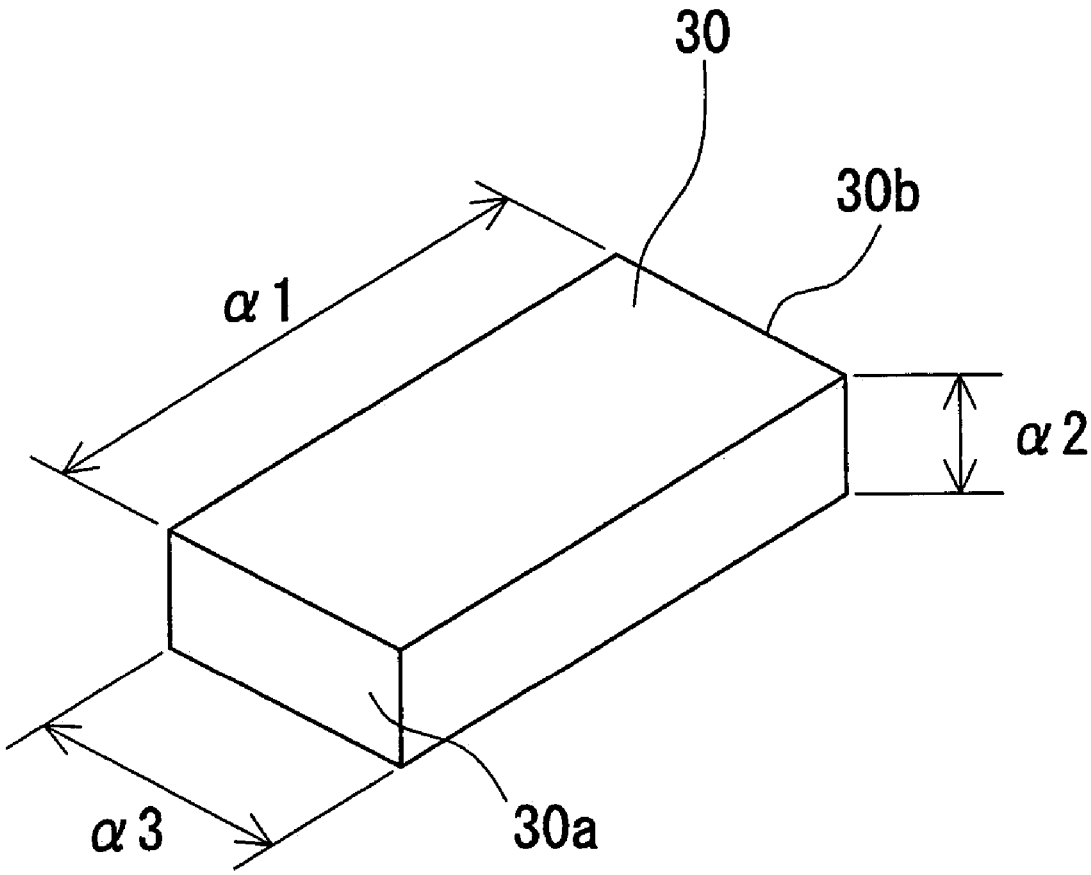
FIG. 8 is a schematic perspective view depicting a dielectric member.
Figure 9:
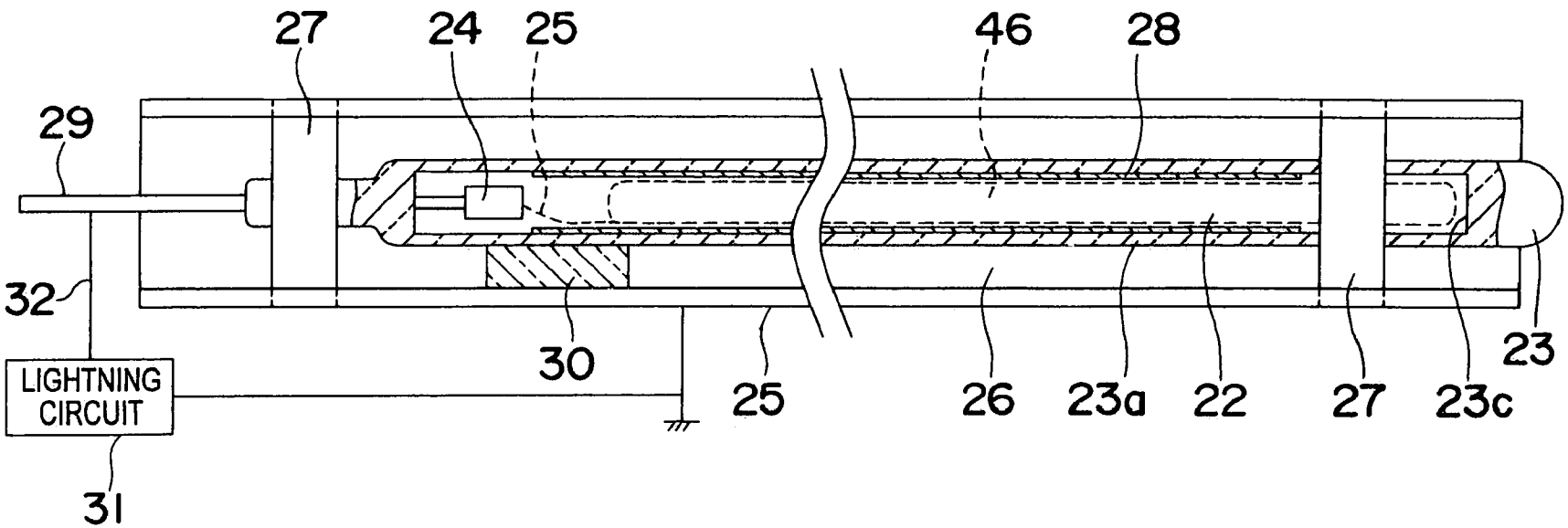
FIG. 9 is a plane view depicting the light source device according to the first embodiment, schematically depicting discharge inside the bulb.
Figure 10A:
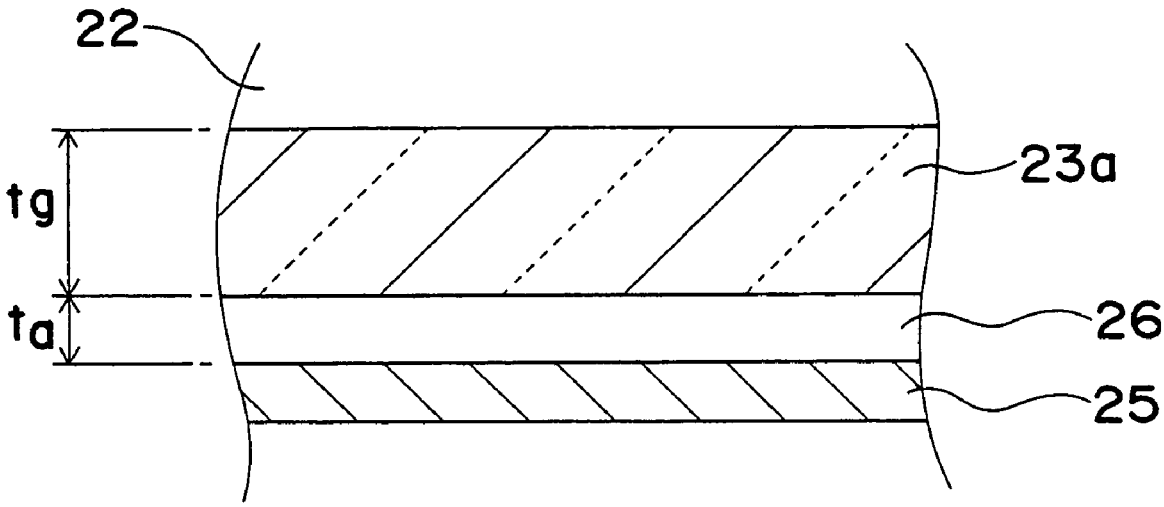
FIG. 10A is a partial schematic cross-sectional view of the light source device.
Figure 10B:
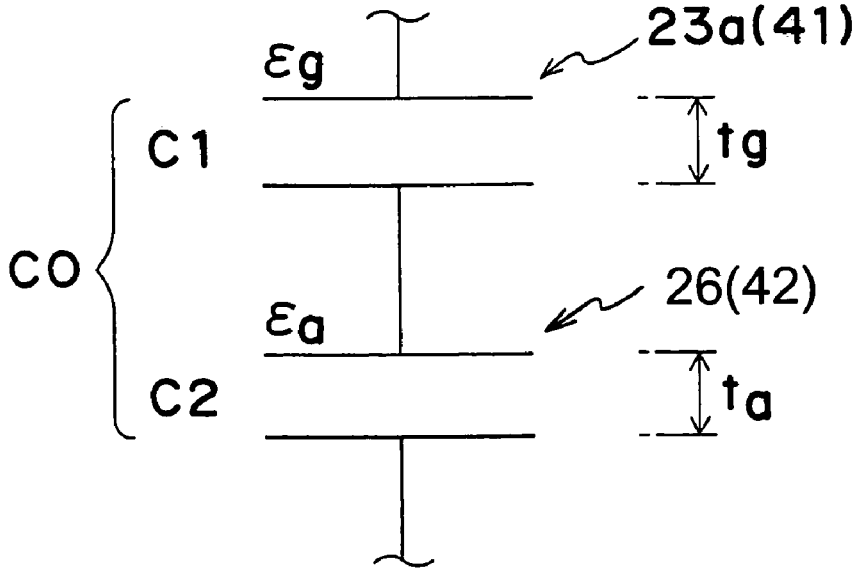
FIG. 10B depicts an equivalent circuit of FIG. 10A.

In this embodiment, the dielectric member 30 is a flat rectangular parallelepiped as shown in FIG. 8. With reference also with FIG. 1, the dimensional of the dielectric member 30 in the direction of the axis line L of the bulb 23, and the position of the dielectric member 30 in the direction of the axis line L, are set so that the distal end 24*b* of an image of the internal electrode 24 projected onto the external electrode 25 positioned on the dielectric member 30. Specifically, the proximal end 30*a* of the dielectric member 30 is positioned on the end portion 23*b* side of the bulb 23 relative to the distal end 24*b* of the internal electrode 24, and the distal end 30*b* of the dielectric member 30 is positioned on the center portion side of the bulb 23 relative to the distal end 24*b* of the internal electrode 24. This setting of the dimensions and position of the dielectric member 30 assures that the dielectric member 30 is formed at least in the portion where contracted discharge occurs and which is on the line (see symbol β in FIG. 4) connecting a point on the axis line L of the bulb 23 and other point on the external electrode 25 at the shortest distance from the point on the axis line L, resulting in the contracted discharge being efficiently fixed. The dimension α1 of the dielectric member 30 in the direction of the axis line L of the bulb 23 is set to approximately not less than 5 mm and not more than 40 mm. In order to reliably fix the contracted discharge, the relative permittivity of the dielectric material for the dielectric member 30 is preferably not less than 4.7.

The relative permittivity of the dielectric member 30 needs to be higher than the relative permittivity of air (1.0). Making the relative permittivity of the dielectric member 30 higher than the relative permittivity of air generates a capacitance distribution in the direction of the axis line L of the bulb 23. Specifically, the capacitance of the portion of the bulb 23 along the dielectric member 30 (the portion corresponding to the internal electrode 24) is grater than the capacitance of other portions (for example the center portion of the bulb 23 in the direction of the axis line L). By the distribution of capacitance, the contracted discharge 45 is drawn to the vessel wall 23*a* of the bulb 23. As a result, the contracted discharge is fixed or the time fluctuations of the contracted discharge are greatly reduced, resulting in elimination of the flicker.

This adjustment of the capacitance is also possible by partially making the dimension of the space 26 between the internal electrode 24 and the external electrode 25 different. However, due to demands for a low-profile in recent light source devices, there is not sufficient space for considerable changes in the space 26. On the other hand, in this embodiment, the provision of the dielectric member 30 enables the spatially partial changes of the capacitance while satisfying spatial constraints.

As shown in FIG. 4, the dielectric member 30 is provided, not so as to surround the outer periphery of the bulb 23 as viewed from the axis line L of the bulb 23, but so as to be arranged to a portion of an outer periphery of the bulb 23. Specifically, the dielectric member 30 is provided only between the bulb 23 and the wall section 36 among the three wall sections 35 to 37 of the external electrode 25. This arrangement of the dielectric member 30 increases the capacitance in a part of the periphery of the bulb 23, so that contracted discharge can be reliably fixed.

Further, the dielectric member 30 is in contact with both the outer surface of the vessel wall 23*a* of the bulb 23, and the wall section 36 of the external electrode 25. By eliminating the gap between the dielectric member 30 and the vessel wall 23*a*, as well as the gap between the dielectric member 30 and the external electrode 25, the dielectric breakdown of the atmospheric gas, and the occurrence of ozone can be prevented.

The operation of the light source device 21 of this embodiment will be explained. Application of a voltage between the internal electrode 24 and the external electrode 25 by the lighting circuit 31 causes the discharge to occur so that the discharge medium within the discharge space 22 is excited. The excited discharge medium emits ultraviolet rays in the event of transitions to the ground state. These ultraviolet rays are converted into visible light by the fluorescent layer 28, and are radiated from the airtight container 10. As explained above, the width "ta" of the space 26 between the bulb 23 and the external electrode 25 is set to be larger than the shortest distance XL, defined by the above equation (10), which achieves stable emission intensity and prevents dielectric breakdown of the atmospheric gas. As shown schematically in FIG. 9, the contracted discharge 45 and the diffused discharge 46 are generated in the discharge space 22. At the portion where the dielectric member 30 is disposed, due to spatially partially increasing of the capacitance of the bulb 23, the discharge 45 is drawn to the vessel wall 23*a* of the bulb 23. As a result, the contracted discharge is fixed, i.e., the time fluctuations in the contracted discharge are greatly reduced, which results in the elimination of the flicker.

A length of the contracted discharge 46 differs depending on the shape of the internal electrode 24, even when a length "γ" of the bulb 23, an outer diameter OD, the width "ta" of the space 26 between the bulb 23 and the external electrode 25, and the voltage applied between the internal electrode 24 and the external electrode 25 are equal. The following conditions are set the outer diameter "OD" of the bulb 23 is 3.00 mm; the thickness "tg2" of the wall container 23*a* is 0.1 mm; the length "γ" is 160 mm; and the width "ta" of the space 26 between the bulb 23 and the external electrode 25 is 0.3 mm. Further, the internal electrodes 24 are provided at both ends of the bulb 23 (see FIG. 18). Furthermore, an input voltage of 20 V is applied to the lighting circuit 31. Under these conditions, when the internal electrodes 24 are shaped so as to comprise an inclined surface at the distal end as shown in FIG. 6D, the contracted discharge length was 25 mm, and when the internal electrodes 24 had the bullet shape shown in FIG. 6C, the contracted discharge length was 15 mm. Using both electrode shapes, the contracted discharge was fixed by the dielectric member 30; but when the length α1 of the dielectric member 30 was 10 mm, the contracted discharge 45 was fixed by the internal electrodes 24 of FIG. 6C, whereas the contracted discharge 45 fluctuated once again on the center portion side of the bulb 23 relative to the distal end 30*b* of the dielectric member 30 when internal electrodes 24 shown in FIG. 6D were used. Thus the bullet shape shown in FIG. 6C is preferable as the internal electrodes 24.

First Experiment Example

Experiments were conducted to confirm the advantageous result of preventing flicker in the light source device 21 of the embodiment. The internal electrodes 24 had the bullet shape of FIG. 6C, the bulb 23 had an outer diameter "OD" of 3.0 mm, thickness "tg" of 0.1 mm, and length "γ" of 160 mm, and the width "ta" of the space 26 was 0.3 mm. A gas mixture of 60% xenon and 40% argon was sealed inside the bulb 23, and the sealed pressure was set to 20 kPa. The dielectric member 30 had the relative permittivity "∈d" of 4.7, width "α3" (see FIG. 8) of 5 mm, and thickness "α2" of 0.3 mm. The dielectric member 30 was positioned so that the distal end 24*b* of the image of the internal electrodes 24 projected onto the external electrode 25 was positioned on the dielectric member 30. The entire length of the internal electrodes 24 was 5 mm. Seven different lengths "γ", which were 0, 6, 10, 20, 30, 40, and 50 mm, were used for the bulb 23. The bulbs 23 with these seven lengths "γ" were used in measurements of the average brightness of the bulb 23 and in subjective evaluations of the flicker. The average brightness of the bulb 23 was measured by setting fifteen points separated by intervals along the direction of the axis line L, including a center in the direction of the axis line L, and calculating an average of the measured brightness values at these fifteen points. Because the flicker in the light source device 21 is prominent during dimming, the flicker during the dimming was evaluated.

Figure 14:
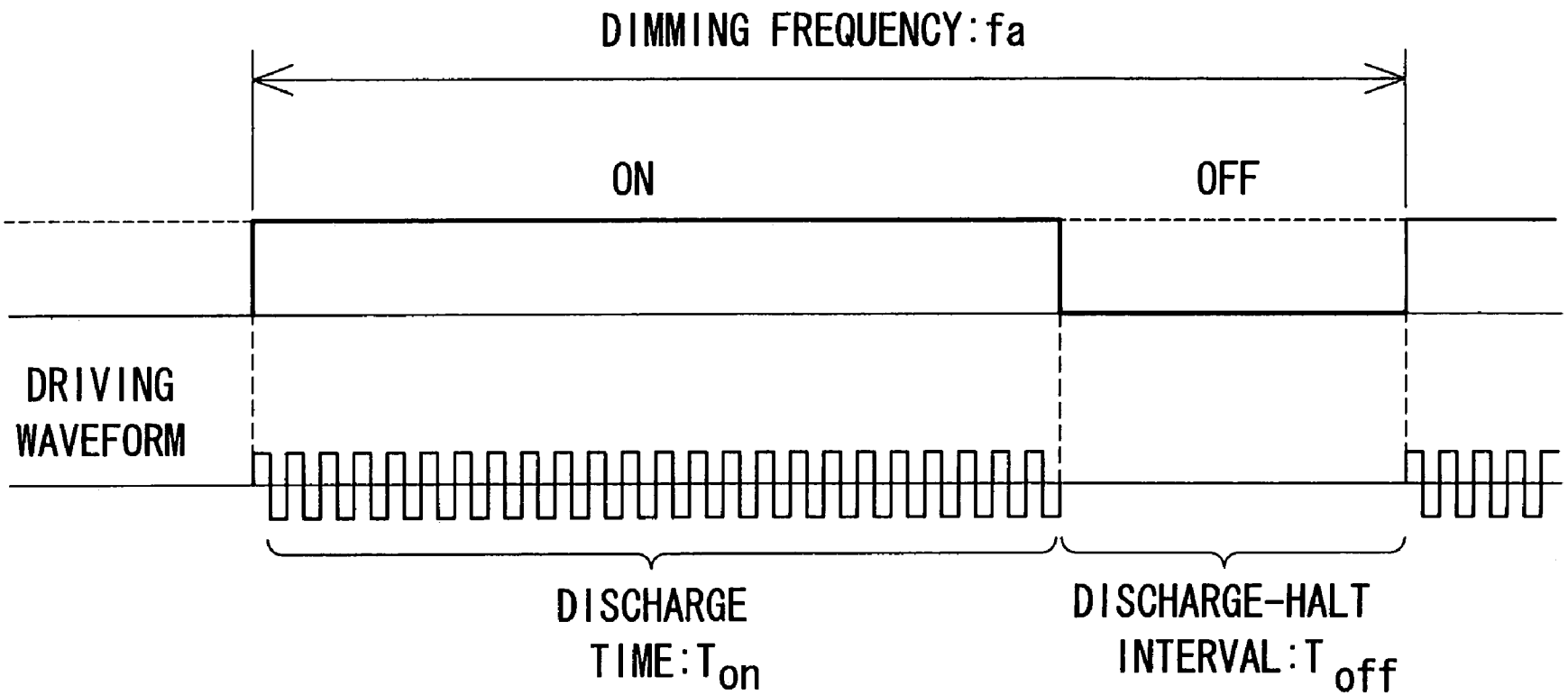
FIG. 14 is a waveform diagram for explaining burst dimming.
Figure 15:
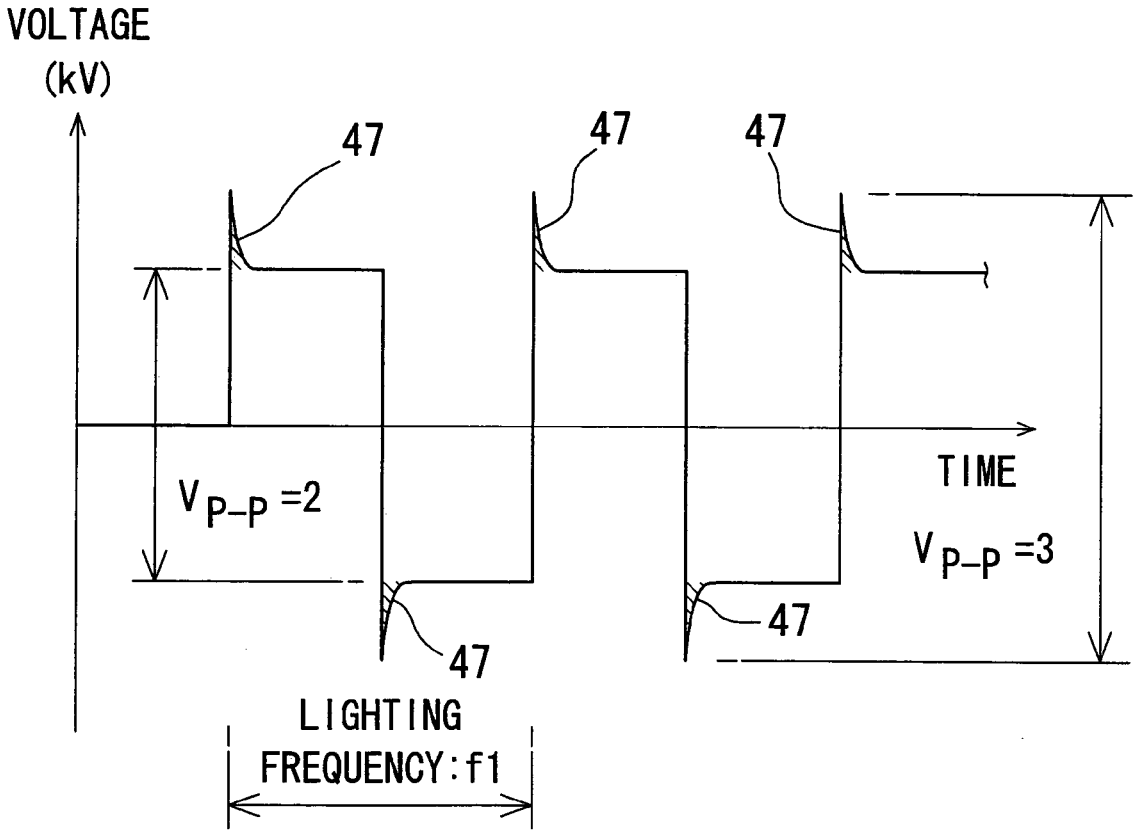
FIG. 15 is a waveform diagram depicting a diving voltage.

Dimming will be explained with reference to FIG. 14 and FIG. 15. A burst dimming method was adopted as the method of dimming. Specially, during dimming intervals "Ton" (on duty) of applying a voltage so as to cause discharges and discharge-halt internals "Toff" (off duty) during which no voltage is applied are provided at a predetermined frequency (dimming frequency "fa"). The light source device 21 is lit during the discharge interval "Ton", and the light source device 21 is extinguished during the discharge-halt interval "Toff". Thus the on/off duty ratio (the ratio between the interval "Ton" and the interval "Toff") is proportional to the brightness of the bulb 23 as perceived by humans. In these experiments, the dimming frequency "fa" was set to 100 Hz. Further, the frequency of the driving voltage (lighting frequency fl) of the lighting circuit 31 was set to 30 kHz. The number of lighting waveforms occurring during an on duty interval "Ton" was 15, for the dimming ratio of 4.5%. The driving voltage peak-to-peak value Vp-p (see FIG. 15) was 2 kV. The peak-to-peak driving voltage value considering overshoots 47 was 3 kV.

As the subjects for subjective flicker evaluations, six adults including both male and female repeated three evaluations. As the flicker evaluation, two grades consisting of "flicker sensed" and "flicker not sensed" were used. For each of seven kinds of lengths "γ" of the bulb 23, a ratio (percentage) of numbers of the evaluation that "flicker was sensed" with respect to a total number of evaluation data (eighteen sets of data) was calculated as an indicator of the subjective evaluation of flicker.

Figure 16:
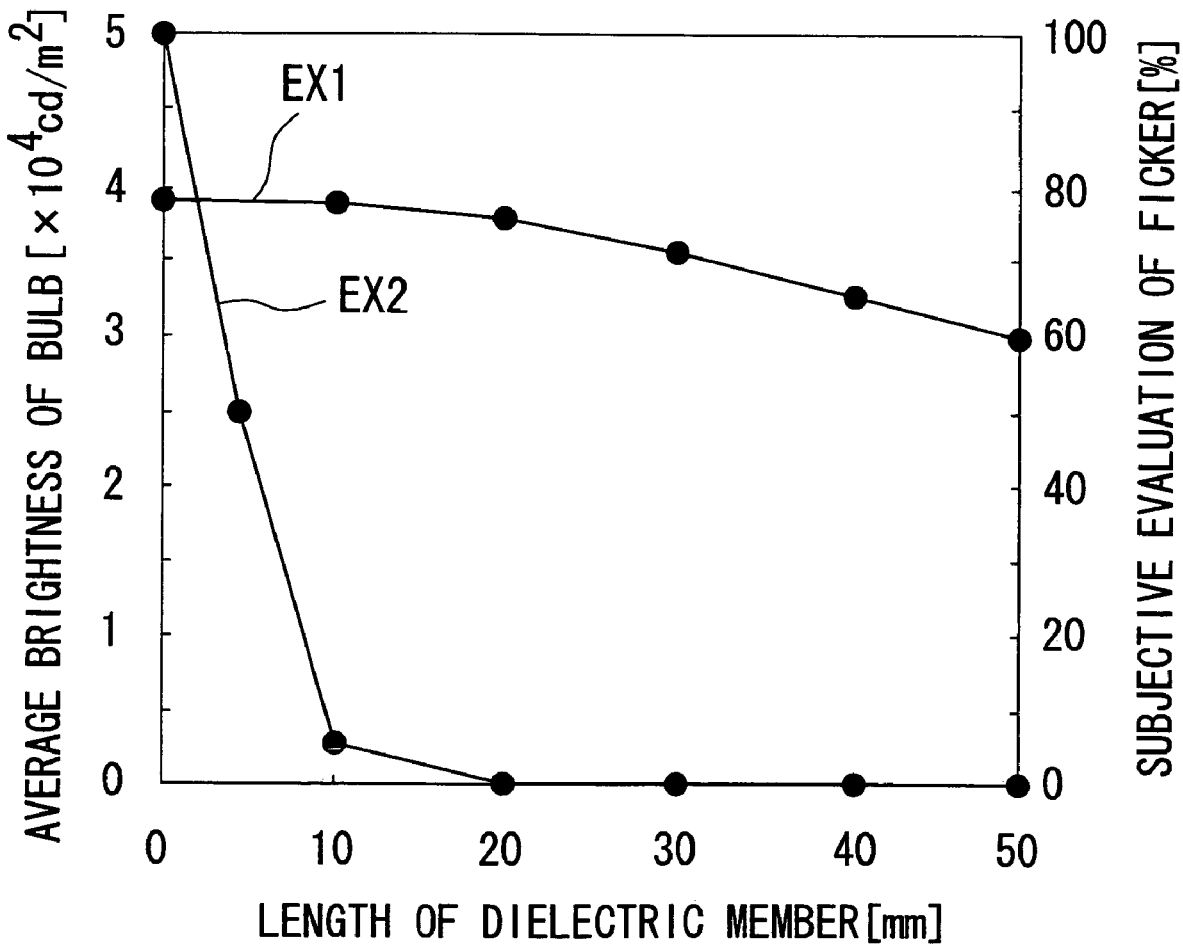
FIG. 16 is a diagram depicting a relation an average brightness of the bulb and subjective evaluation of flicker with respect to a length of the dielectric member and in a first experimental example.

The symbol "EX1" in FIG. 16 indicates the average brightness of the bulb 23, and "EX3" indicates the result of subjective flicker evaluation. As is clear from FIG. 16, when the length of dielectric member 30 is set to the same value, i.e., 20 mm, as the length of the contracted discharge (20 mm), the subjective flicker evaluation is 0%, so that substantially complete elimination of the flicker is confirmed. When the length of the dielectric member 30 is set so as to be longer than that of the contracted discharge length (20 mm), there is no change in the subjective flicker evaluation, but the average brightness of the bulb 23 is decrease. This is because, if the dielectric member 30 is made too long, then the dielectric member 30 extends beyond the portion of the contracted discharge and exists in an area where the dielectric discharge occurs, resulting in a portion of the diffused discharge being drawn to the dielectric member 30 and the light flux in this portion being reduced. For the above reasons, it is preferable that the length of the dielectric member 30 is set to be equal to or less than that of the diffused discharge.

Second Experiment Example

Experiments were performed to investigate the relation between the relative permittivity "∈d" of the dielectric member 30 and the effect in suppressing the flicker. The shape and dimensions of the bulb 23 and space 26 were the same as in the first experiment example. The dimensions of the dielectric member 30 were constant, with the width "α3" equal to 5 mm, the length "α1" equal to 20 mm, and the thickness "α2" equal to 0.3 mm. Six types of dielectric member 30, each of which has the relative permittivity "∈d" of 1.5, 2.5, 3.0, 4.7, 5.7, and 8.0, were used. The subjective evaluations of the flicker were performed for all of these six kinds of relative permittivity "∈d". As the subjects for the subjective flicker evaluations, similar to the first experiment example, six adults including male and female repeated three evaluations. Further, as the evaluation, two grades consisting of "flicker sensed" and "flicker not sensed" were used. For each of the six kinds of relative permittivity "∈d", the ratio (percentage) of numbers of the evaluation that "flicker was sensed" with respect to a total number of evaluation data (eighteen sets of data) was calculated as an indicator of the subjective evaluation of flicker.

Figure 17:
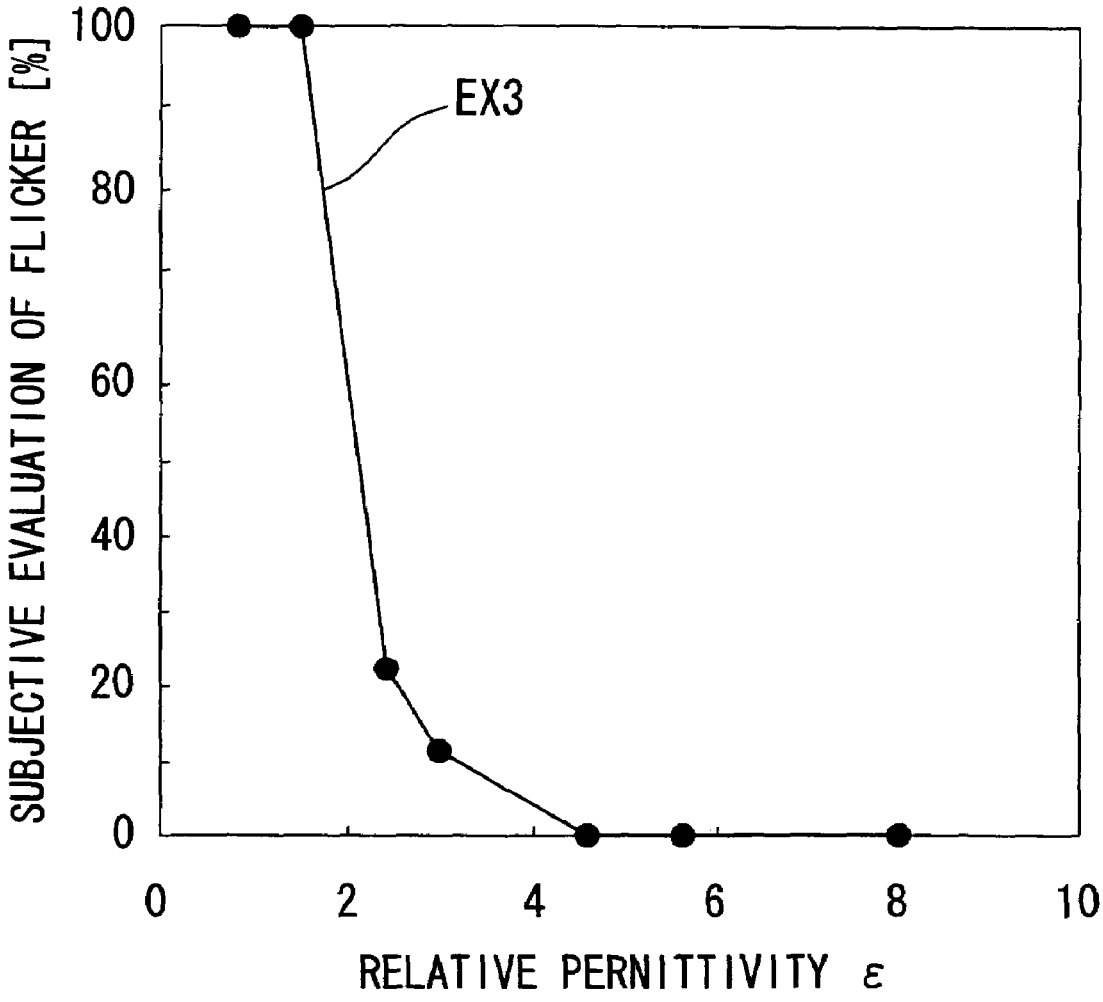
FIG. 17 is a diagram depicting a relation between the relative permittivity of the dielectric member and subjective evaluation of flicker in a second experimental example.

The reference symbol "EX3" in FIG. 17 indicates the experimental results of the second experiment example. As is clear from FIG. 17, when the relative permittivity "∈d" of the dielectric member 30 was not less than 4.7, the subjectively evaluated flicker was 0%, so that flicker due to fluctuations in the contracted discharge was not observed.

When the relative permittivity is increased, the capacitance becomes larger, so that the input current to the lighting circuit 31 increases resulting in increase of power consumption under the condition that the voltage applied to the lighting circuit 31 is constant or for example, when the length "γ" of the straight tube-shaped bulb 23 is 160 mm, if no dielectric member 30 is provided and the input voltage is 20 V, then the input current is 0.48 A, and the power consumption is 9.6 W. On the other hand, if the dielectric member 30 with relative permittivity "∈d" of 4.7 is provided, and the input voltage is 20 V, then the input current is 0.49 A and the power consumption is 9.8 W, so that the power consumption increases by approximately 20% compared with the case in which the dielectric member 30 is not inserted, and the amount of light flux declines slightly. Further, when the dielectric member 30 with the relative permittivity "∈d" of 8 is provided, if the input voltage is 20 V, then the input current is 0.50 A and the power consumption is 10 W, so that the power consumption increases by approximately 4% compared to the case in which the dielectric member 30 is not inserted. Therefore, usage of the dielectric member 30 having higher relative permittivity more than necessary causes decrease of the luminous flux and increase of the power consumption, resulting in reduced efficiency. When the power consumption increase is to be limited to approximately 4%, the relative permittivity "∈d" needs to be not more than 8.

From the above, it is preferable that the relative permittivity "∈d" of the dielectric member 30 needs to be not less than 4.7 and not more than 8.

Figure 18:
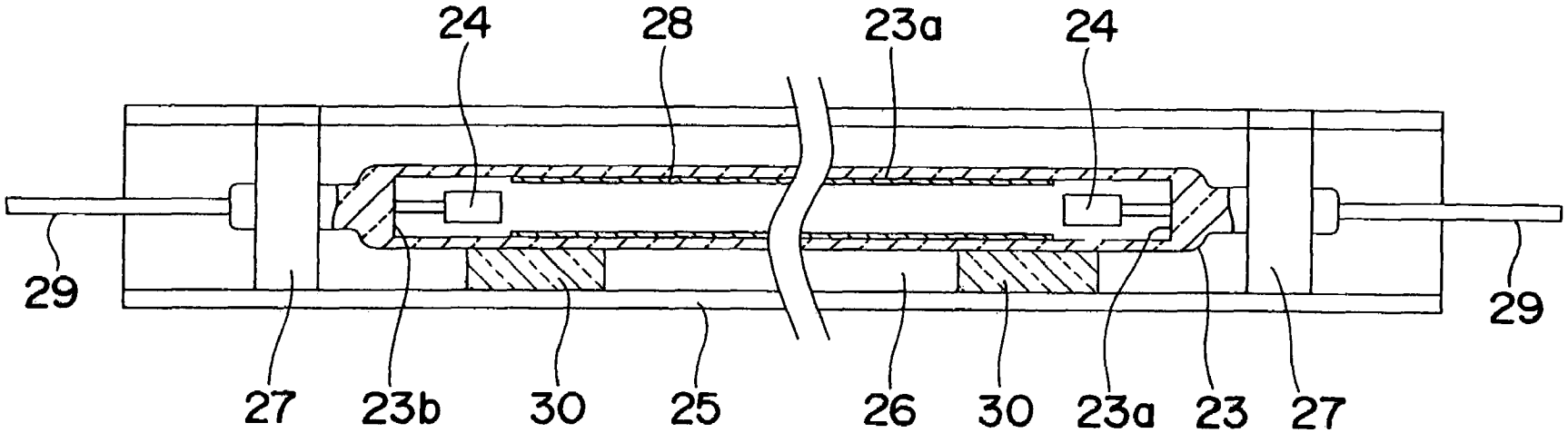
FIG. 18 is a plane view depicting a modification of the first embodiment.
Figure 19:
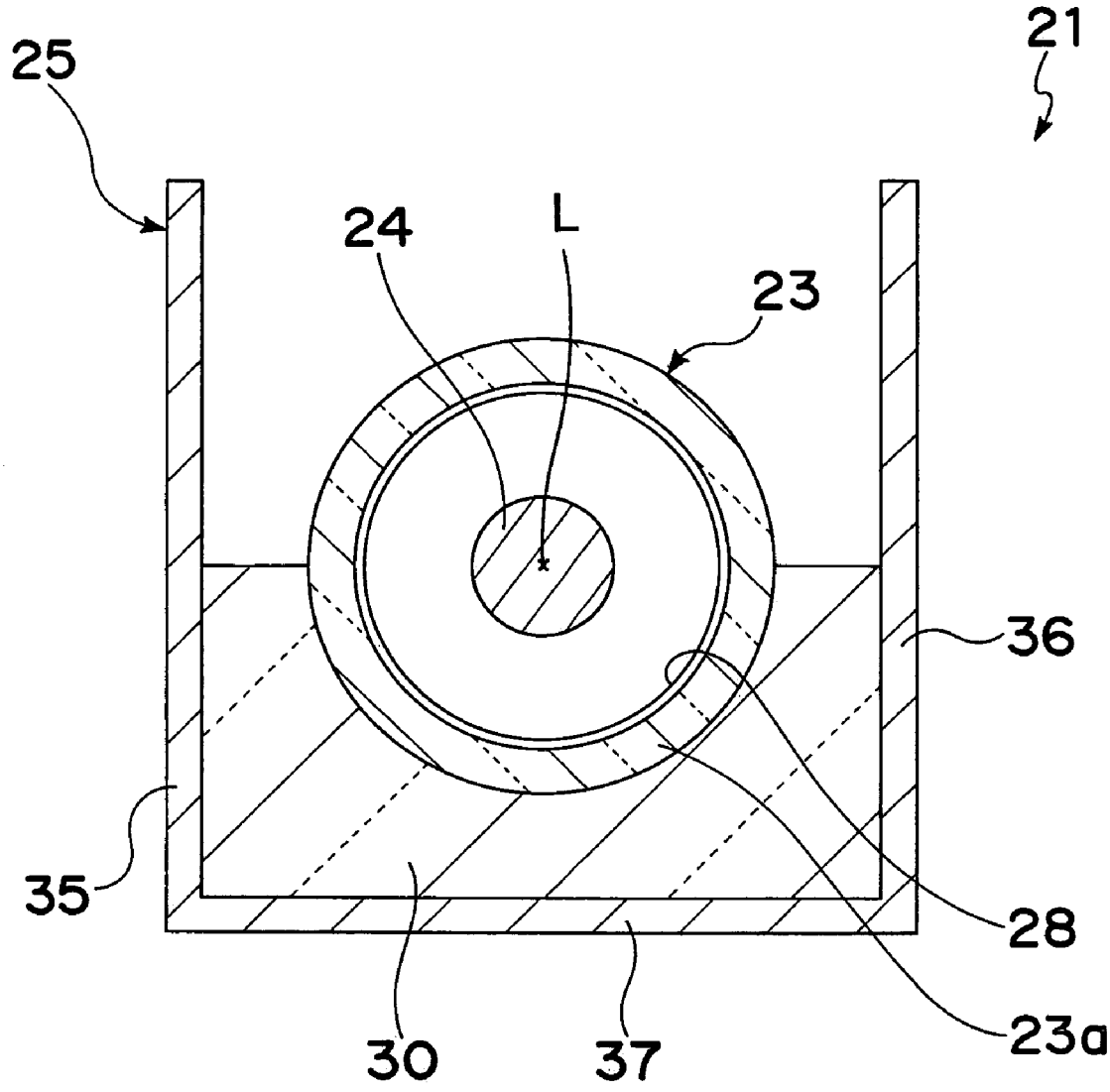
FIG. 19 is a cross-sectional view depicting other modification of the first embodiment.

FIG. 18 shows a modification of the first embodiment. In the light source device 21 of this modification, internal electrodes 24 are provided at both ends of the bulb 23. FIG. 19 shows another modification of the first embodiment. In the light source device 21 of this modification, the dielectric member 30 is in contact with approximately half of the outer periphery of the bulb 23 as viewed from the direction of the axis line L.

Figure 20:
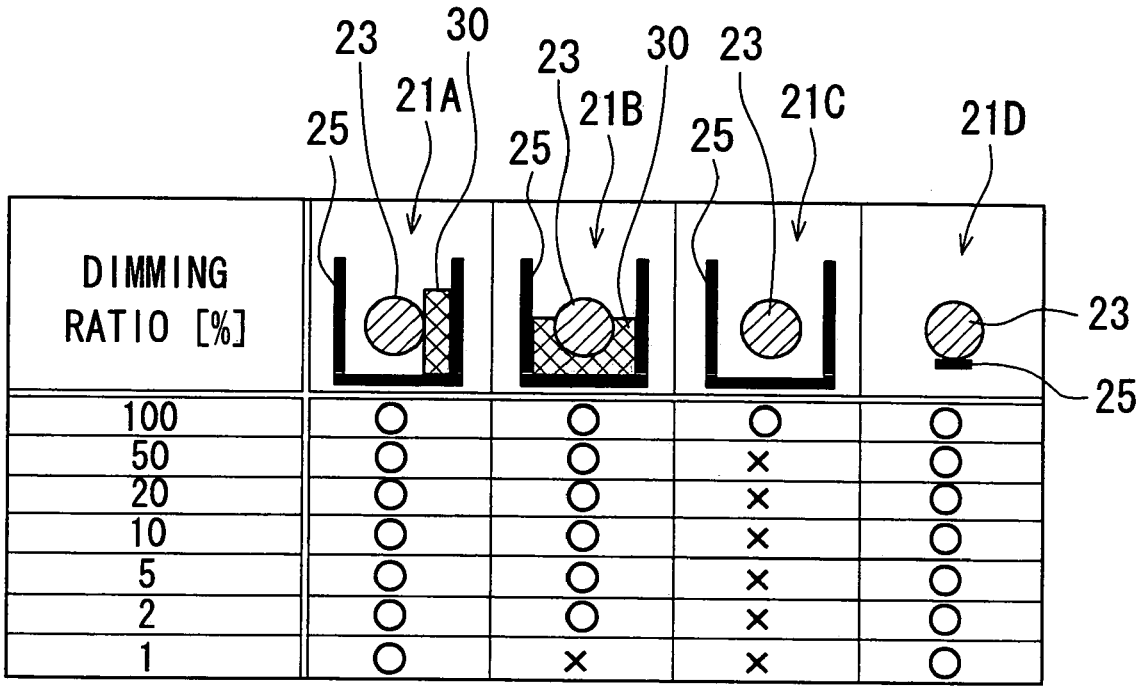
FIG. 20 conceptually depicting a relation between a dimming ratio and an occurrence of flicker in various arrangements of light source devices.
Figure 21:
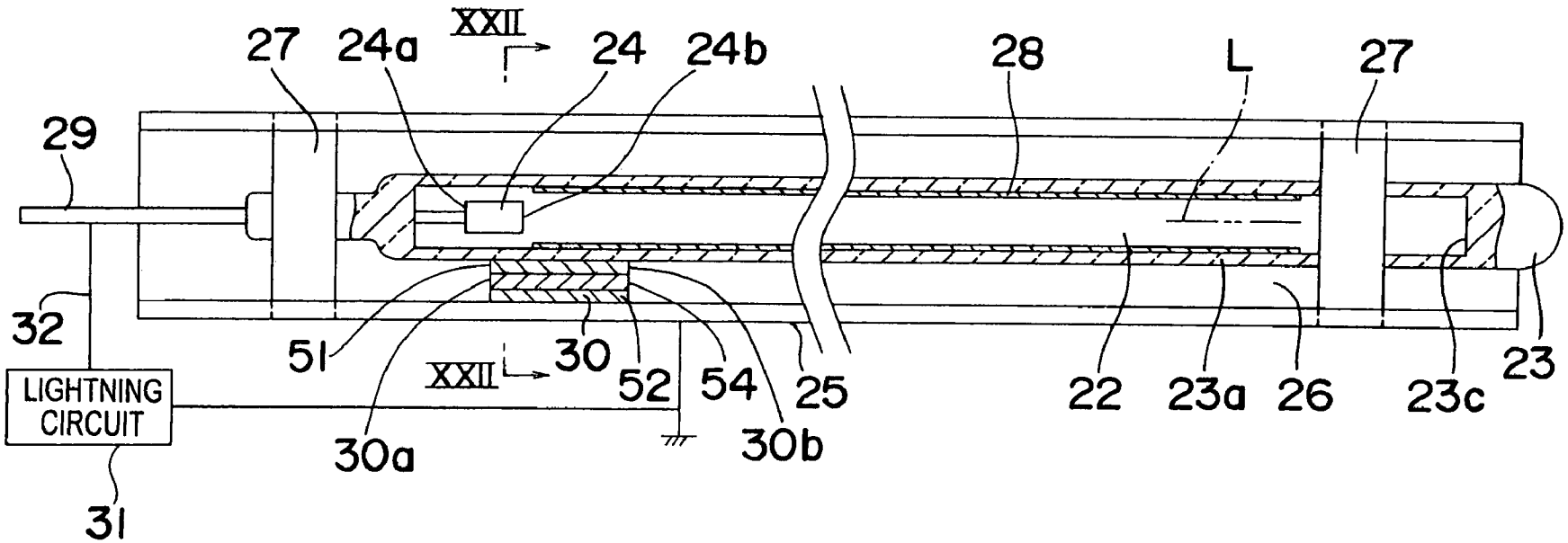
FIG. 21 is a plane view depicting a light source device according to a second embodiment of the invention.
Figure 22:
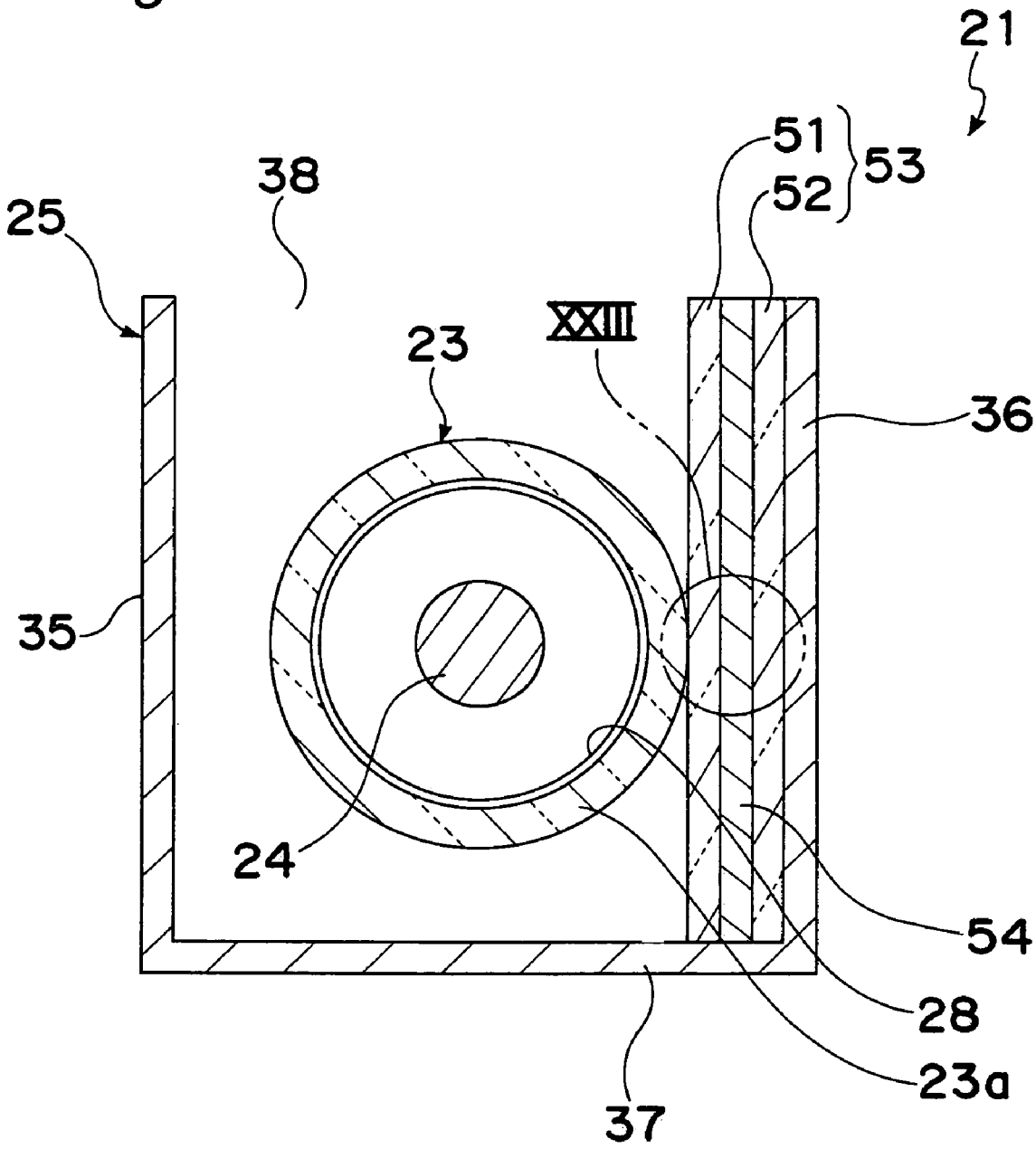
FIG. 22 is a schematic enlarged cross-sectional view taken along a line XXII-XXII in FIG. 21.

FIG. 20 shows the relations between the form of the external electrode 25, the presence or absence of a dielectric member 30 and the form of the dielectric member 30, and the extent of flicker when the dimming ratio is changed. In FIG. 20, "○" indicates a case where the flicker is not perceived by a human, and "x" indicates a case where the flicker is perceived. In the light source device 21A having the dielectric member 30 provided only on one side of the external electrode 25 as viewed from the dielectric of the axis line L as in this embodiment, the flicker is prevented over the range of dimming ratios from 100% to 1%. In the light source device 21B having the dielectric member 30 provided in approximately half of the outer periphery of the bulb 23 as viewed from the direction of the axis line L, the flicker occurs when the dimming ratio is approximately 1%, i.e., when the dimming ratio is made high and the brightness of the bulb 23 is reduced. When no dielectric member 30 is provided, the flicker does not occur at the dimming ratio of 100%, i.e., when no dimming is executed, but the flicker occurs when the dimming is executed (for dimming ratios from 50% to 1%). As explained above, in the light source device 21D having the external electrode 25 in contact with the bulb 23, the flicker does not occur even during dimming, but the emission intensity is unstable, and dielectric breakdown of atmospheric gas occurs. As is clear also from FIG. 20, the light source device 21 of this embodiment is superior with respect to stabilization of the emission intensity, prevention of the dielectric breakdown of the atmospheric gas, and also reduction of flicker.

Second Embodiment

Figure 23:
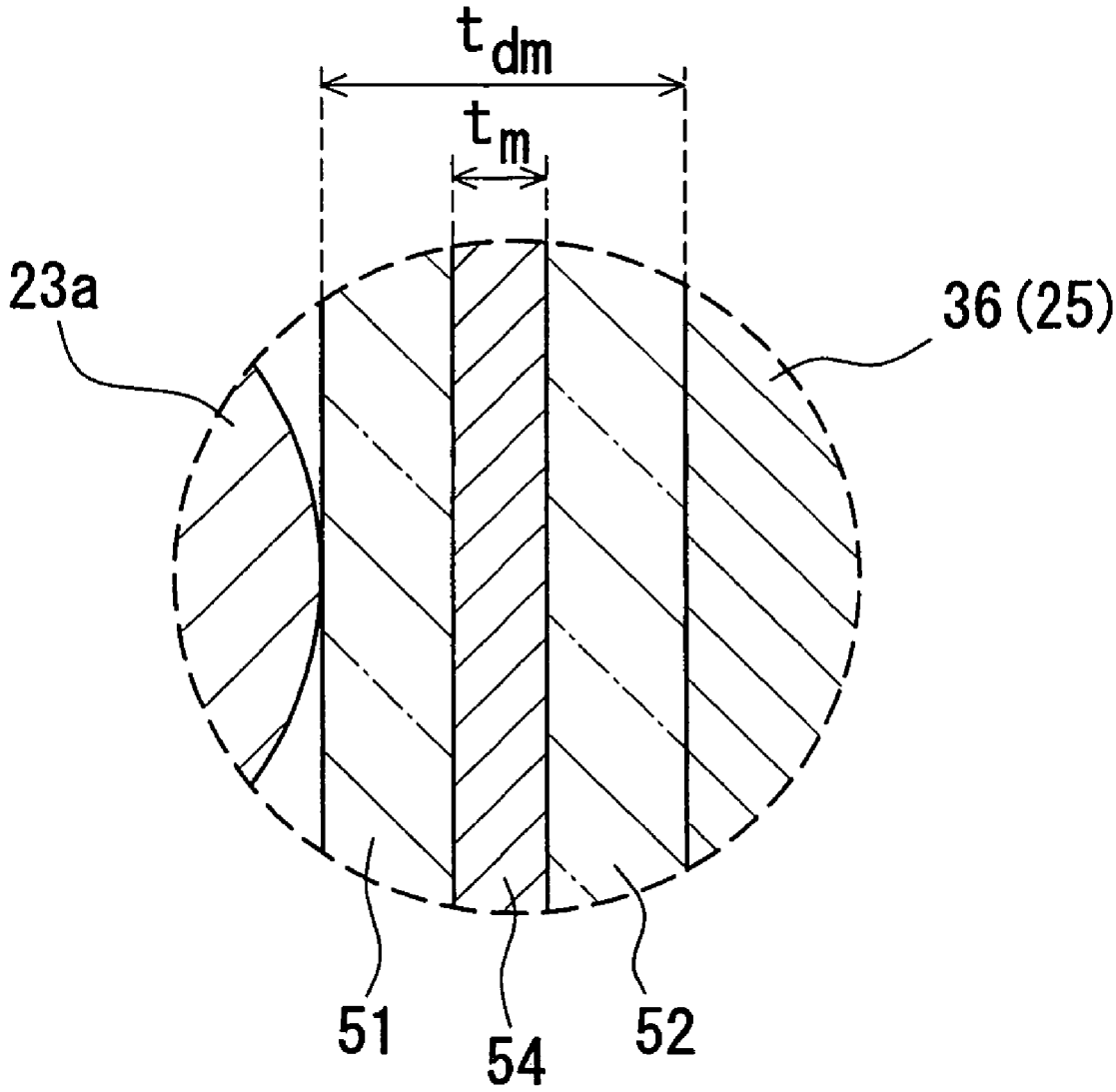
FIG. 23 is an enlarged view of a portion XXIII-XXIII in FIG. 22.
Figure 24A:
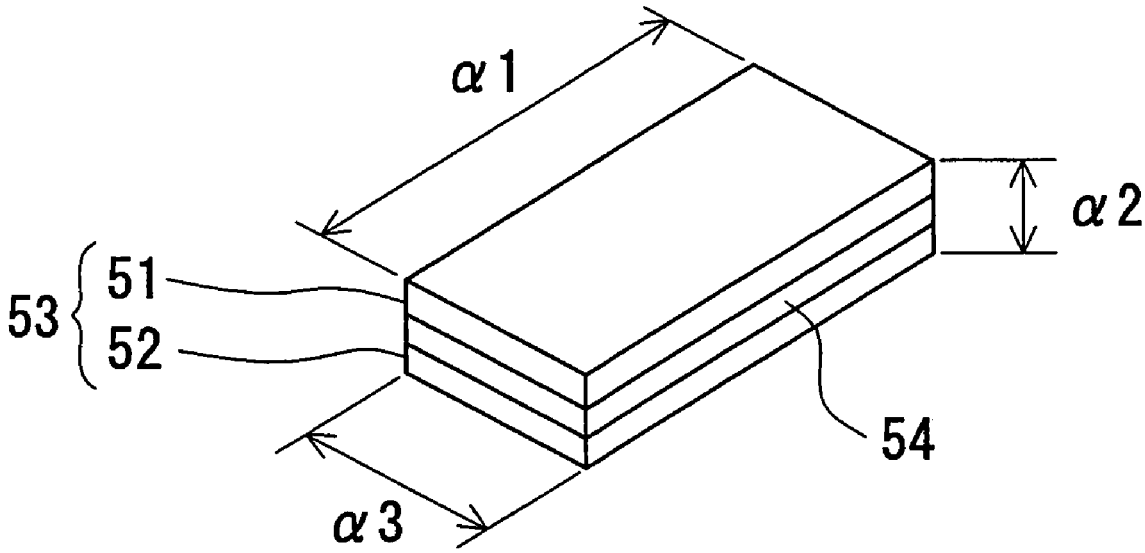
FIG. 24A is a perspective view depicting a dielectric member in the second embodiment.
Figure 24B:
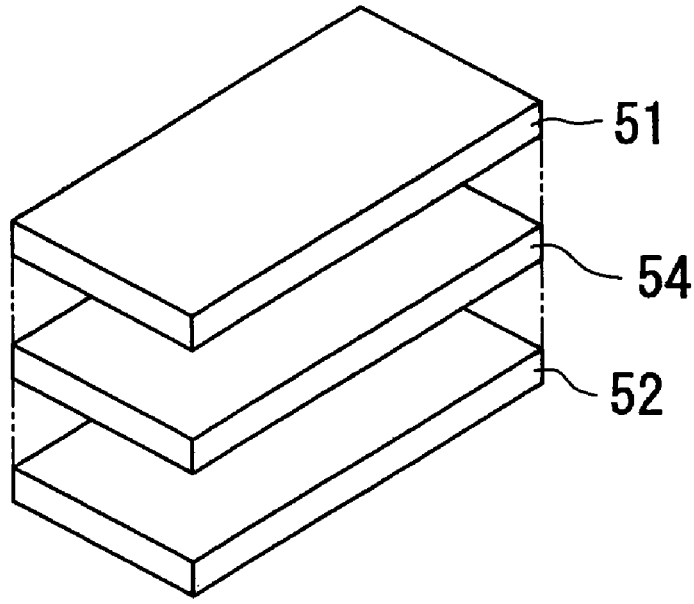
FIG. 24B is an exploded schematic view depicting the dielectric member in the second embodiment.
Figure 25:
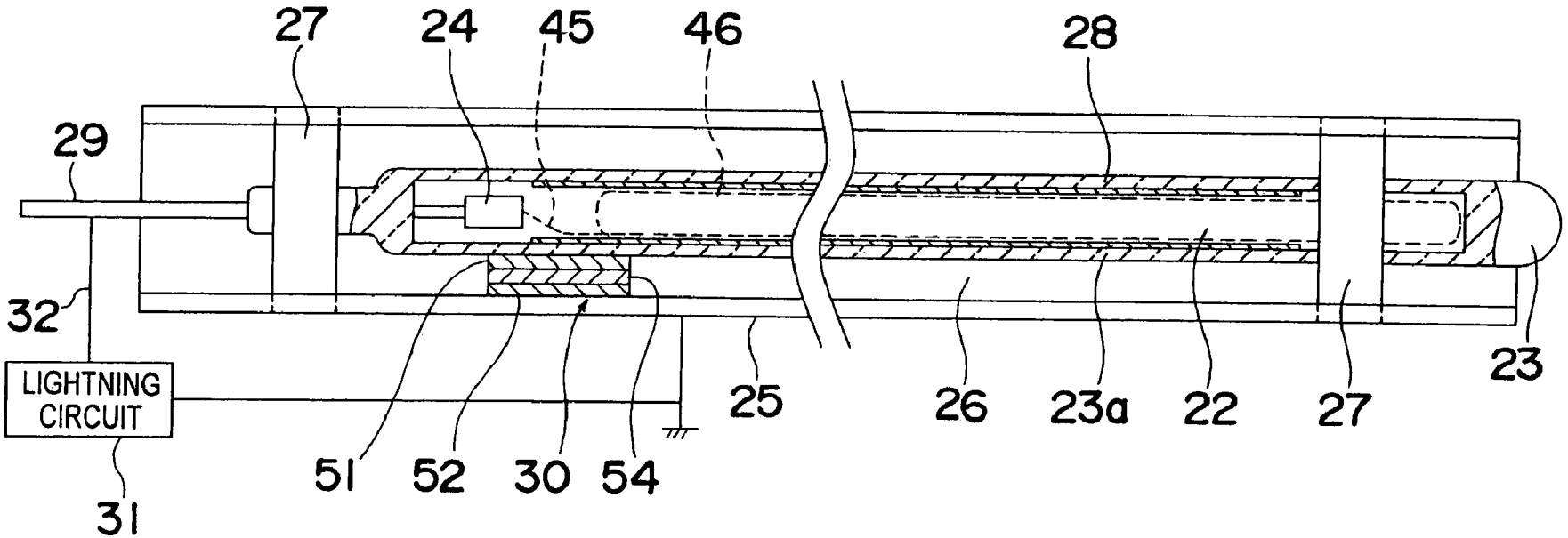
FIG. 25 is a plane view depicting the light source device according to the second embodiment, schematically depicting discharge inside the bulb.

The light source device 21 of a second embodiment of the present invention shown in FIG. 21 through FIG. 24B, differs from the first embodiment in the structure of the dielectric member 30. As is shown most clearly in FIG. 24A, the dielectric member 30 is a flat rectangular parallelepiped, comprising a dielectric portion 53, which includes a first dielectric layer 51 placed on the side of the bulb 23 and a second dielectric layer 52 placed on the side of the external electrode 25, and a conductive layer (conductor portion) 54 placed between the first dielectric layer 51 and the second dielectric layer 52. The first dielectric layer 51 is in contact with the outer periphery of the vessel wall 23*a* of the bulb 23, and the second dielectric layer 52 is in contact with the wall portion 36 of the external electrode 25. In this embodiment, as shown in FIG. 24B, the conductive layer 54 has a sheet shape. The sheet-shaped conductive layer 54 is preferable in view of facilitation of the manufacturing of the dielectric member 30. As shown in FIG. 25, the provision of the dielectric member 30 prevents or reduces the time fluctuations in the contracted discharge 45, thereby eliminating the flicker.

The reason for providing a conductive layer 54 between the first and second dielectric layers 51 and 52 will be explained. Because the dielectric member 30 is placed between the bulb 23 and the external electrode 25, it is preferable that the dielectric material used in the dielectric member 30 is a highly transparent material. However, in general the higher the transparency of the dielectric material, the lower the relative permittivity of the dielectric material will be. For example, the relative permittivity of "TSE3033" from GE Toshiba Silicones, a high transparent silicone, is 2.7, whereas the relative permittivity of "XE20" from GE Toshiba Silicones, a low transparency silicone (and a brown color), is 5.2. When the dielectric member 30 is made of only the dielectric material, if a dielectric material with a low relative permittivity is used in preferentially considering the transparency, then the contracted discharge 45 cannot be fixed by the dielectric member 30. Thus in this embodiment, the conductive layer 54 is provided in order to increase the capacitance of the dielectric member 30 without lowering the transparency of the dielectric member 30.

The capacitance "C'" of the dielectric member 30 can be calculated as follows. With reference to FIG. 23, it is defined that the sum of the thicknesses of the two dielectric layers 51 and 52 between which the conductive layer 54 is interposed is "td", and that the relative permittivity is "∈". Further, it is defined that the thickness of the conductive layer 54 is "tm", and that the total thickness of the dielectric member 30 is "tdm". In this case, because the relation "tdm=td+tm" is established, the following equation (17) is obtained regarding the capacitance "C'" of the dielectric member 30.

$$C' \propto \in/(tdm-tm) \tag{17}$$

The capacitance "C'" of the dielectric member 30 is inversely proportional to (tdm−tm), and increases with the insertion of the conductive layer 54. In other words, by placing the conductive layer 54 between the dielectric layers 51 and 52, the capacitance can be increased without altering the thickness of the dielectric member 30. Thus even when a dielectric material with high transparency and low permittivity is used in the dielectric layers 51 and 52, the decrease in the capacitances of the dielectric layers 51 and 52 can be compensated by the conductive layer 54, resulting in prevention of the flicker due to the time fluctuations in the contracted discharge 45.

In view of preventing reduction of light output efficiency, it is preferable that the first and second dielectric layers 51 and 52 are made of silicone or another transparent resin. Further, the conductive layer 54 can be made of a conductive metal such as aluminum or stainless steel.

An excessively thick conductive layer 54 results in too thin first and second dielectric layers 51 and 52, thereby potentially causing dielectric breakdown. In the case of the light source device used in a liquid crystal display device, it is preferable that the thickness of the conductive layer 54 is set to not more than 0.2 mm.

In view of suppressing the generation of ozone, it is preferable that the conductive layer 54 is sandwiched between the first and second dielectric layers 51 and 52 as in this embodiment. The conductive layer 54, exposed with respect to the bulb 23 and external electrode 25, generates a large potential difference that appears in the conductive layer 54, which tends to generate ozone.

Since the other arrangements and functions of the second embodiment are the same as those of the first embodiment, the same elements are denoted by the same reference symbols, and descriptions thereof are omitted.

Third Experiment Example

Experiments were conducted to confirm that in the light source device 21 of this embodiment, flicker can be suppressed even when using a dielectric material with low relative permittivity in the first and second dielectric layers 51 and 52.

The bulb 23 had an outer diameter "OD" of 3.0 mm, thickness "tg" of 0.5 mm, and length "γ" of 160 mm, the width "ta" of the space 26 was 0.3 mm. Further, a gas mixture of 60% xenon and 40% argon was sealed inside the bulb 23 at a pressure of 20 kPa. The external electrode 25 had a total length of 160 mm, and the height of the wall portions 35, 36, and 37 were respectively 5.0 mm, 5.0 mm, and 3.6 mm.

The dielectric member 30 had first and second dielectric layers 51, 52 and a conductive layer 54 of width "α3" equal to 5 mm, length "α1" equal to 20 mm, and thickness "α2" equal to 0.1 mm. The conductive layer 54 was made of aluminum. The positional relation between the dielectric member 30 and the internal electrode 24 was set so that when the internal electrode 24 was projected onto the external electrode 25, which closely contacted the dielectric member 16, a portion of the projection of the internal electrode 24 on the discharge space side overlapped the dielectric member 30 within a range of 2 mm.

As dimming conditions, the dimming frequency "fa" was set to 240 Hz. The frequency of the driving voltage generated by the lighting circuit 31 (lighting frequency "fl") was set to 30 kHz. The number of lighting waveforms generated on the on duty interval "Ton" (see FIG. 14) was two, and the dimming ratio was 1.4%. The peak-to-peak driving voltage "Vp-p" (see FIG. 15) was 2 kV.

Under the above conditions, evaluations were performed for six types of dielectric member 30 of this embodiment, each having the first and second dielectric layers 51 and 52 with relative permittivity "∈d" of 1.5, 2.5, 3.0, 4.7, 5.7, and 8.0. As comparison examples, devices having dielectric members not provided with a conductive layer 54 were fabricated and similarly subjected to evaluation. The dielectric members in these comparison examples had a sheet shape, of width 5 mm, length 22 mm, and thickness 0.3 mm. The comparison examples differed from the device of this embodiment only with respect to the dielectric member. The relative permittivity was modified by changing the type of silicone rubber material used.

As the subjects for subjective flicker evaluations, six adults including male and female repeated three evaluations. As the flicker evaluation, two grades consisting of "flicker sensed" and "flicker not sensed" were used. For each of six kinds of relative permittivity "∈d", a ratio (percentage) of numbers of the evaluation that "flicker was sensed" with respect to a total number of evaluation data (eighteen sets of data) was calculated as an indicator of the subjective evaluation of flicker.

Figure 26:
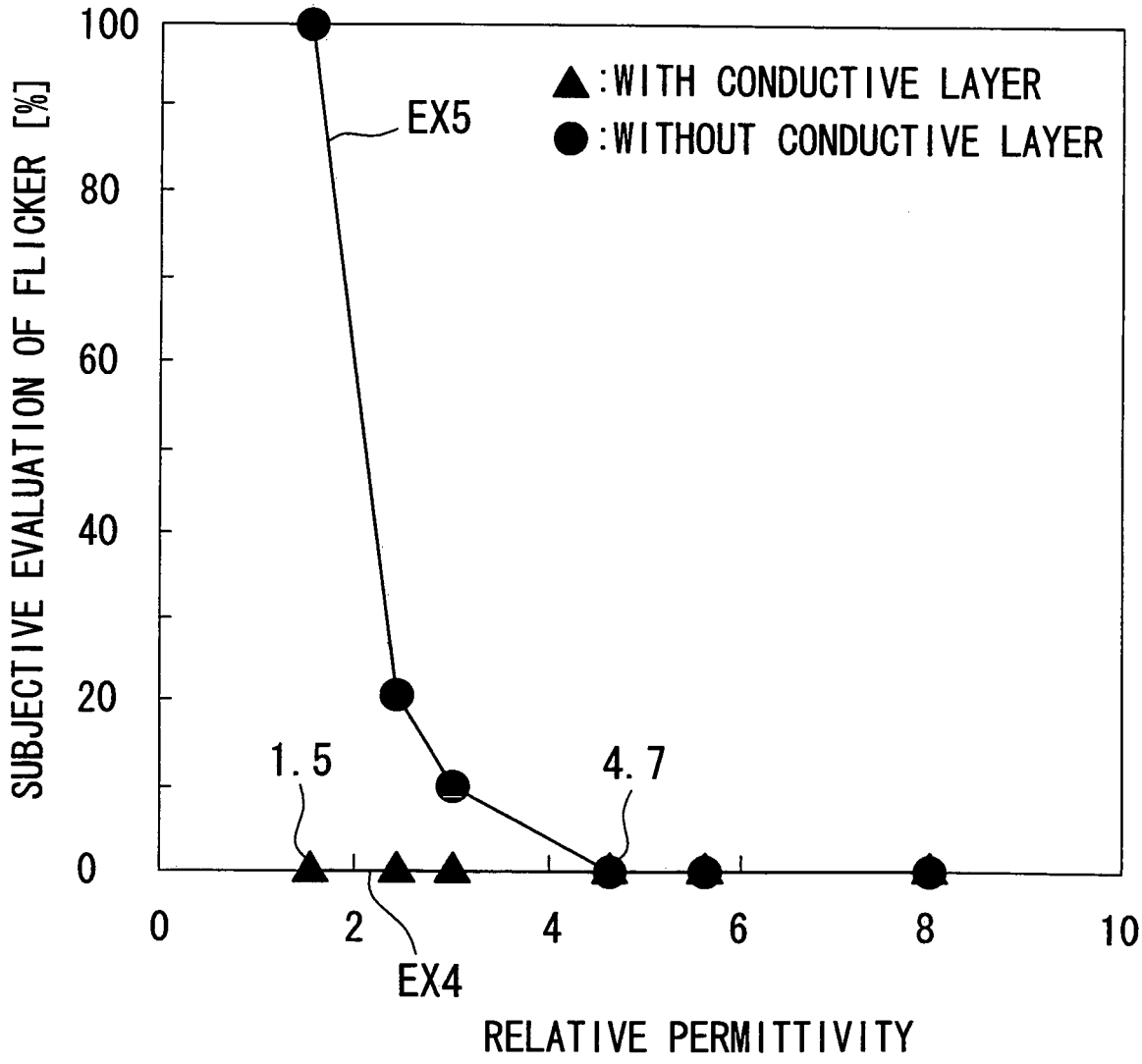
FIG. 26 is a diagram depicting a relation between the relative permittivity and subjective evaluation of flicker in a third embodiment.

The reference symbol "EX4" in FIG. 26 indicates the results of the subjective flicker evaluation for this embodiment, and "EX5" denotes the subjective flicker evaluation for the comparison example. As is clear from FIG. 26, when the conductive layer 54 is provided, and the relative permittivity of the first and second dielectric layers 51 and 52 is not less than 1.5, the subjective flicker evaluations were not more than 0%, resulting in a finding that there was almost no tendency to sense flicker due to the time fluctuations in the contracted discharge 45. On the other hand, when no conductive layer 54 was provided, the subjective flicker evaluations were increased greatly for first and second dielectric layers 51 and 52 having a relative permittivity of not more than 4.7, and the subjects perceived the flicker. From the above results, by providing the conductive layer 18 in the dielectric member 30 as in this embodiment, even when using a material with low relative permittivity but high transparency in the first and second dielectric layers 51 and 52, the capacitance can be made large without increasing the thicknesses of the first and second dielectric layers 51, 52 (the thickness of the dielectric member 30), and flicker can be eliminated without increasing the electric field intensity. Thus, the light source device 21 of this embodiment can achieve both flicker prevention, and a compact size for the light source device 21.

Fourth Experiment Example

Experiments were conducted on the light source device 21 of the second embodiment to investigate the relation of the length "α3" of the dielectric member 30 with respect to the effect in suppressing flicker and the average brightness of the bulb 23. The light source device 21 was the same as that of the third experiment example. However, the relative permittivity ∈d of the first and second dielectric layers 51, 52 was held constant at 1.5. The method of flicker evaluation was the same as in the third experiment example. The average brightness of the bulb 23 was measured by setting fifteen points separated by intervals along the direction of the axis line L, including a center in the direction of the axis line L, and calculating an average of the brightness values measured at these fifteen points.

Figure 27:
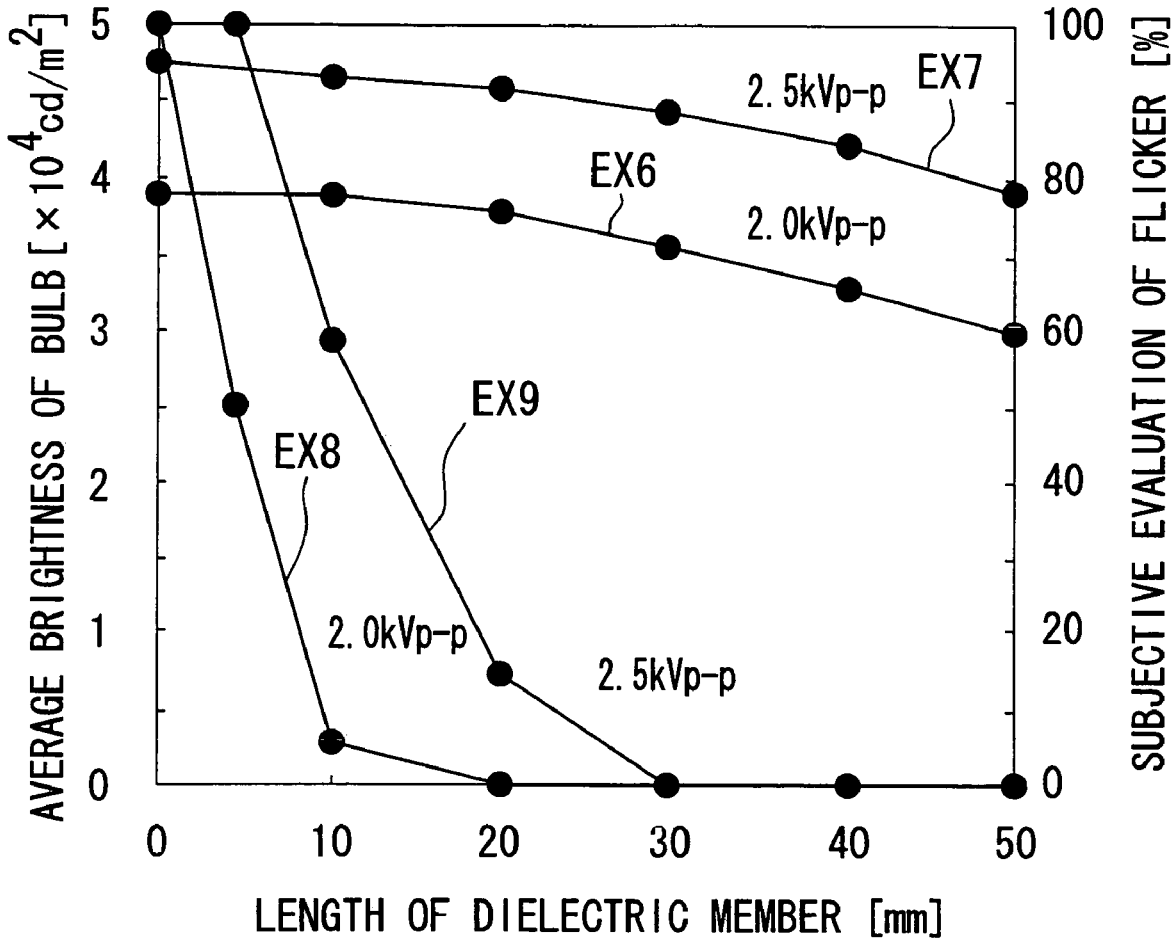
FIG. 27 is a diagram depicting a relation an average brightness of the bulb and subjective evaluation of flicker with respect to a length of the dielectric member and in a fourth experimental example.

In FIG. 27, the reference symbols "EX6" and "EX7" denote the average brightness of the bulb 23, and the symbols "EX8" and "EX9" denote the result of subjective flicker evaluations. When the applied voltage was 2.0 kVp-p and 2.5 kVp-p, the length of the contracted discharge was 20 mm and 30 mm respective. If the lengths of dielectric members 30 at these voltages are set to be increased respectively to not less than 20 mm and not less than 30 mm, the average brightness of the bulb 23 is reduced, whereas there are no changes in the subjective flicker evaluations. This is because, if the dielectric member 30 is made too long, then the dielectric member 30 extends beyond the portion of the contracted discharge 45 and into the area of the diffused discharge 46, so that a portion of the diffused discharge 46 is drawn to the dielectric member 30 and the light flux in this portion is reduced. Thus, in the case of a dielectric member 30 comprising dielectric layers 51, 52 and a conductive layer 54 as in the second embodiment, it is preferable that the length "α1" of the dielectric member 30 is set to not more than the length of the contracted discharge.

Figure 28:
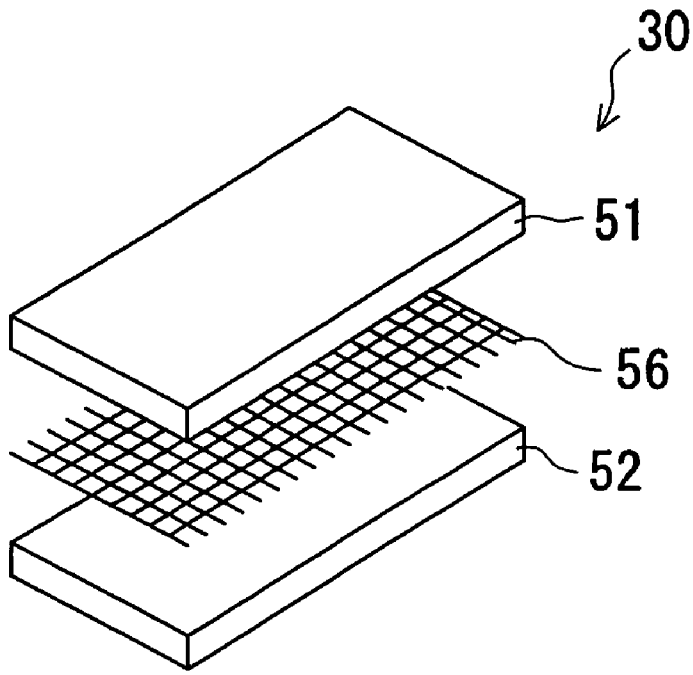
FIG. 28 is an exploded schematic view depicting other example of the dielectric member.
Figure 29:
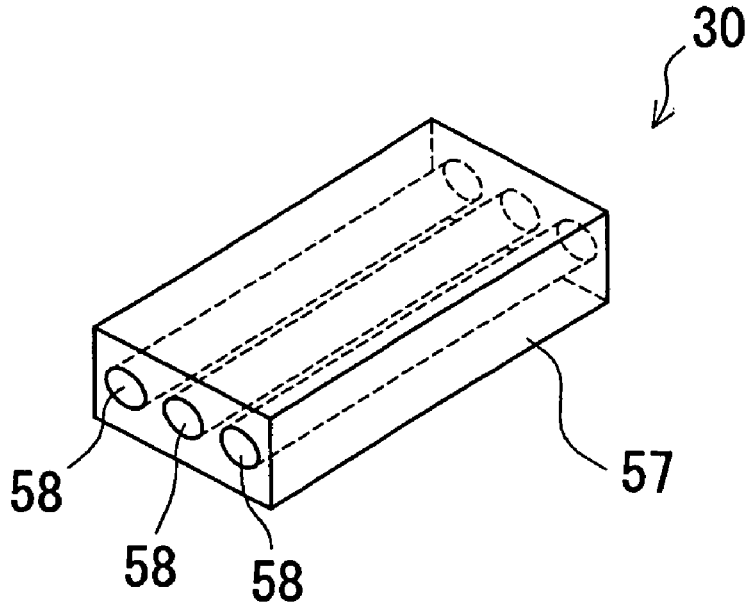
FIG. 29 is an exploded schematic view depicting other example of a dielectric member.

FIG. 28 and FIG. 29 show alternatives of the dielectric member 30 of the second embodiment. In the alternative of FIG. 28, the dielectric member 30 comprises sheet-shape first and second dielectric layers 51 and 52, between which a mesh layer 56 of a conductive material is provided. In the alternative of FIG. 29, the dielectric member 30 comprises three rod members (elongated rods) 58 formed of a conductive material within a single dielectric portion 57.

Third Embodiment

Figure 30:
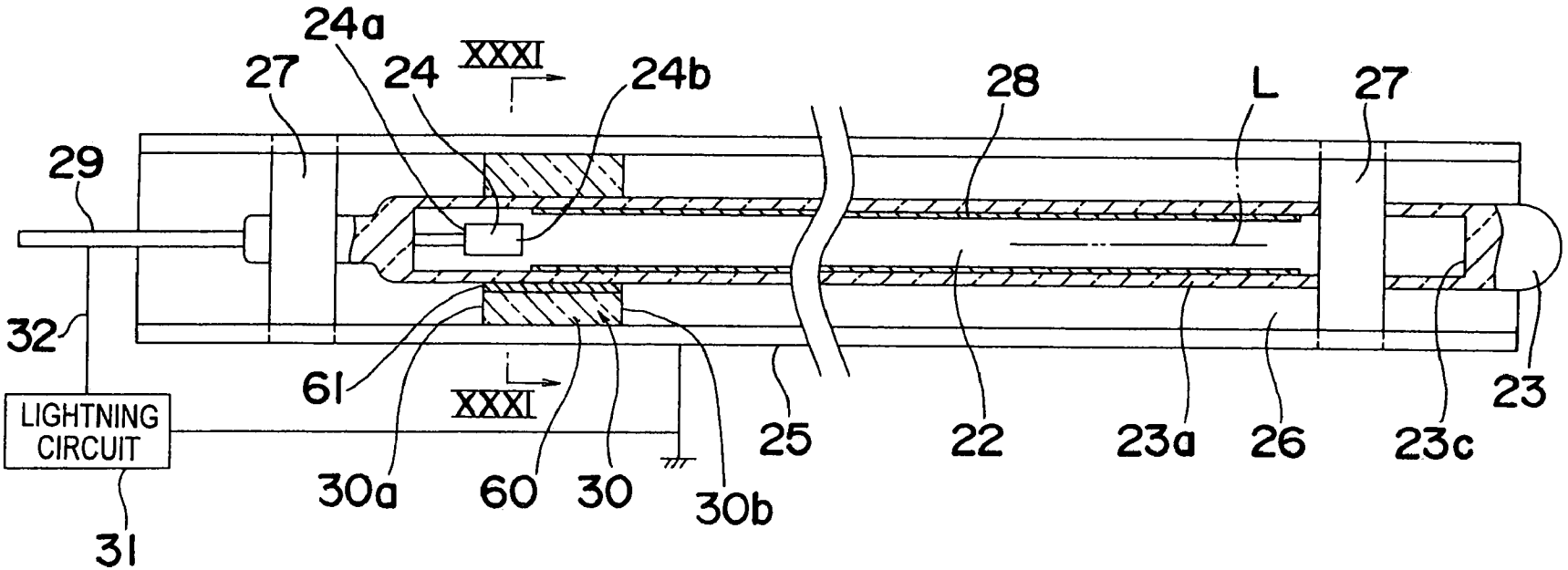
FIG. 30 is a plane view depicting a light source device according to a third embodiment of the present invention.
Figure 31:
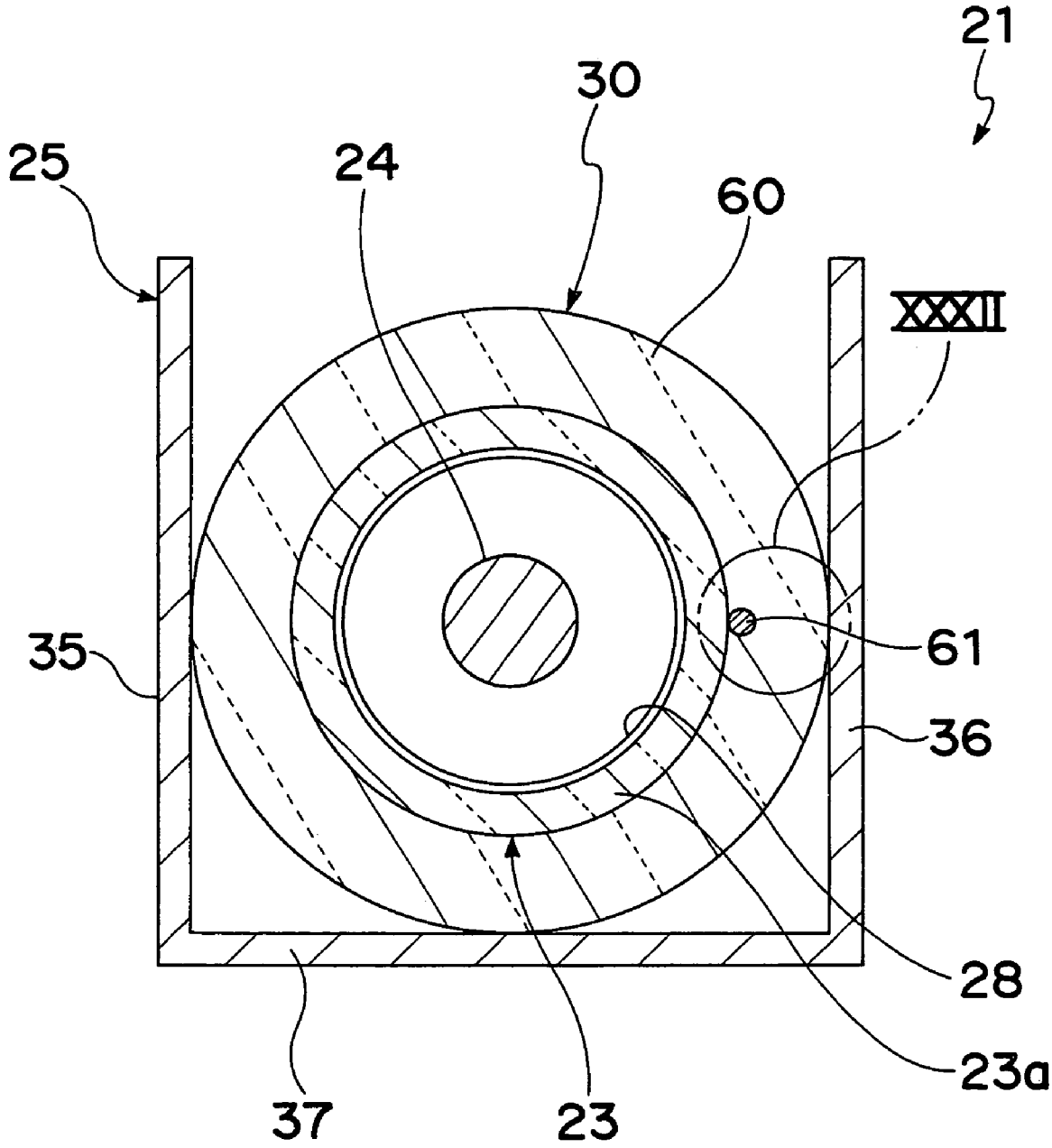
FIG. 31 is a cross-sectional view taken along a line XXXI-XXXI in FIG. 30.
Figure 32:
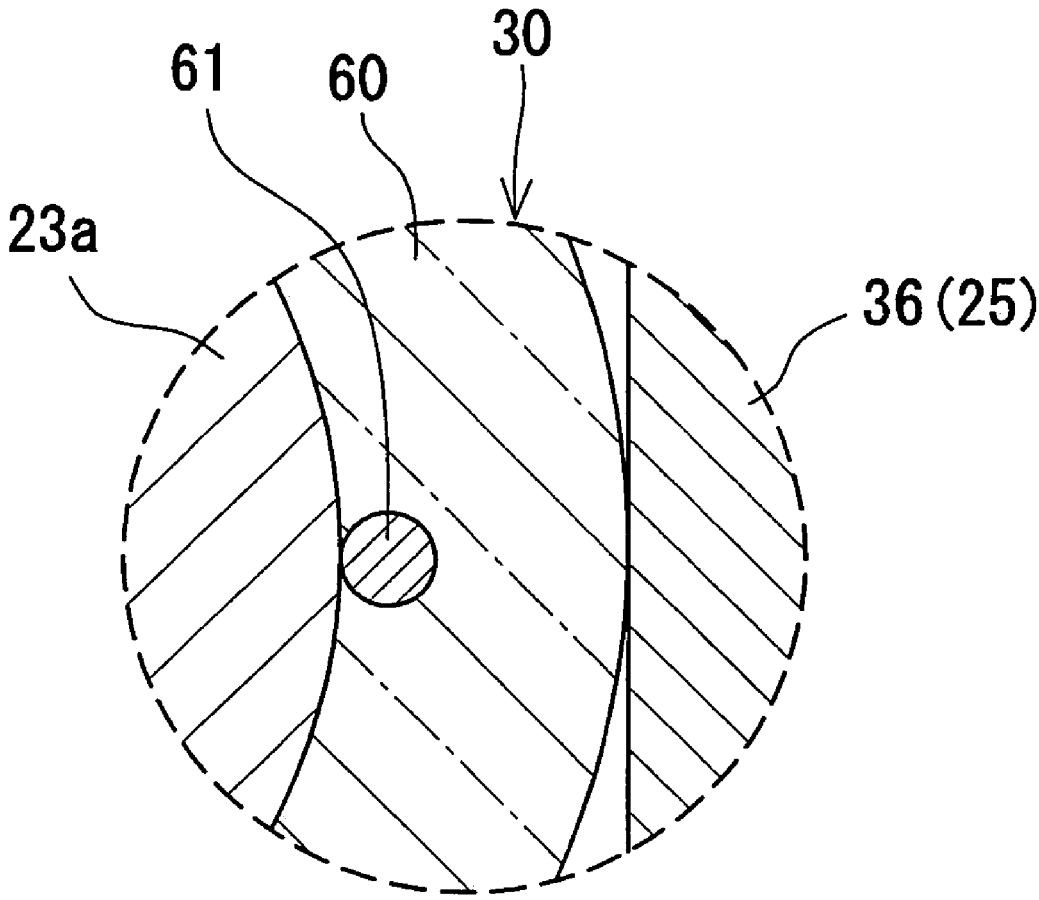
FIG. 32 is an enlarged view of a portion XXXII-XXXII in FIG. 30.

FIG. 30 through FIG. 32 show the light source device 21 of a third embodiment of the invention. In the third embodiment, the dielectric member 30 is of cylindrical in shape, open at both ends, and comprises a dielectric portion 60 having an entire inner surface that is in dose contact with the outer periphery of the bulb 23, and the outer periphery is in contact with the wall sections 35 to 37 of the external electrode 25. The dielectric member 30 further comprises a single line or wire member 61 disposed inside the dielectric portion 60, extending in the direction of the axis line L of the bulb 23, and made of a conductive material. This wire member 61 is positioned in the vicinity of the bulb 23 in the area between the bulb 23 and one of the wall portions 36 of the external electrode 25. By providing the wire member 61 of a conductive material within the dielectric portion 60, the capacitance of the dielectric member 30 can be increased, so that even if a dielectric material with low relative permittivity is used in the dielectric portion 60, the time fluctuations in the contracted discharge 45 can be suppressed and the flicker can be eliminated.

Since the other arrangements and functions of the second embodiment are the same as those of the first embodiment, the same elements are denoted by the same reference symbols, and descriptions thereof are omitted.

Fourth Embodiment

Figure 33:
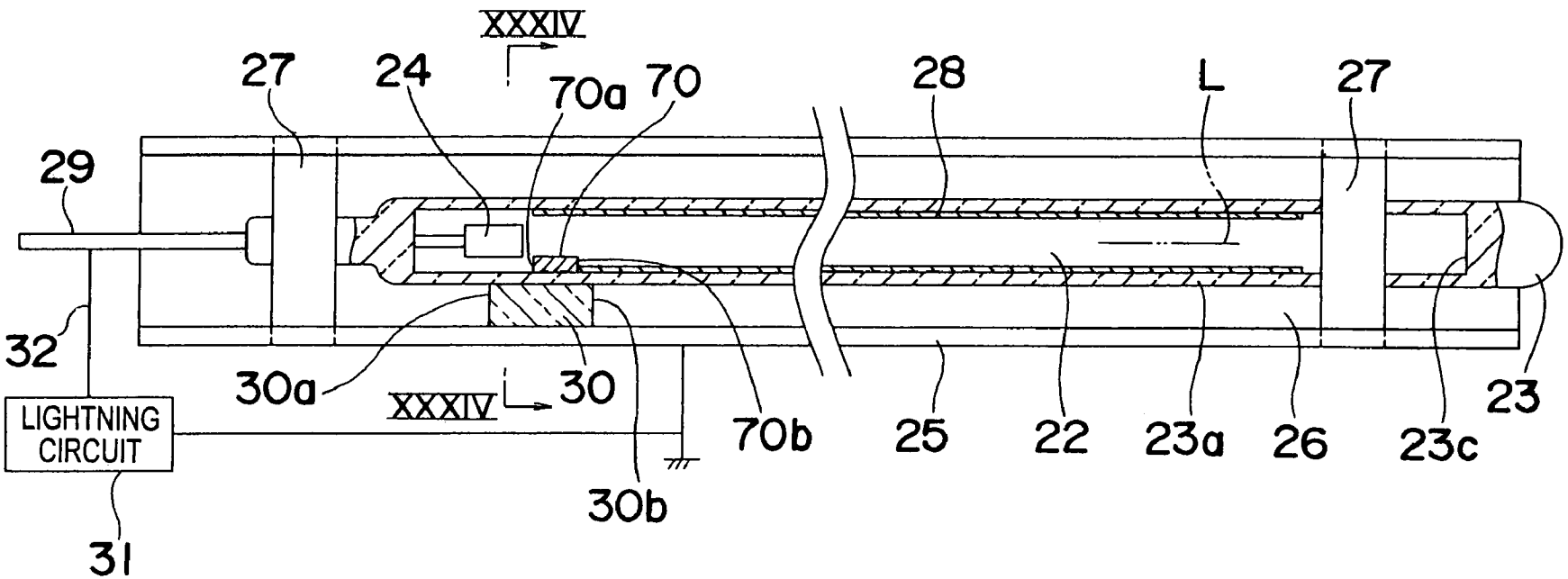
FIG. 33 is a plane view depicting a light source device according to a fourth embodiment of the present invention.
Figure 34:
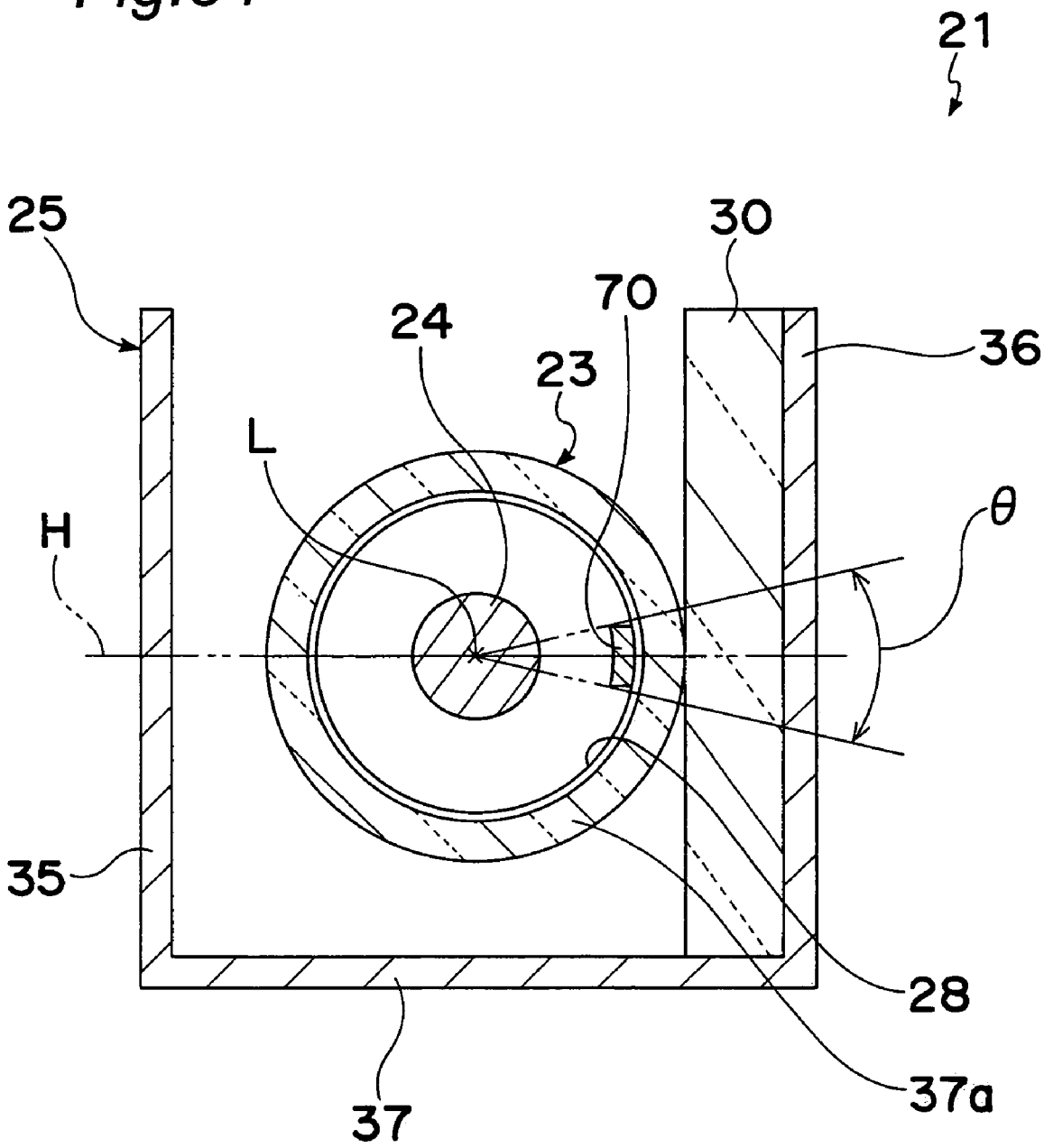
FIG. 34 is a schematic enlarged cross-sectional view taken along a line XXXIV-XXXIV in FIG. 33.

The light source device 21 of a fourth embodiment of the invention shown in FIG. 33 and FIG. 34, comprises, in addition to a dielectric member 30 similar to that of the first embodiment, a conductive member 70 made of a conductive material. As will be explained in detail below, this conductive member 70 has the function of reliably suppressing the flicker when the dimming ratio is increased (when the brightness of the bulb 23 is set to a dark level).

The conductive member 70 is formed by applying the conductive metal such as aluminum or nickel to the inner surface of the vessel wall 23*a* of the bulb 23 in the vicinity of the internal electrode 24, i.e., in the portion where the discharge paths tend to be contracted.

In order to reliably suppress the time fluctuations in the contracted discharge, it is preferable that the conductive member is provided on a portion of the bulb 23 as viewed from the direction of the axis line L of the bulb 23. In this embodiment, as shown in FIG. 34, the cross-sectional shape of the conductive member 70 in the cross-section perpendicular to the axis line L of the bulb 23 is an arc shape, positioned within the range ±30° with respect to the horizontal direction H as indicated by a reference symbol "θ". However, the cross-sectional shape of the conductive member 70 is not particularly limited. Moreover, the dimension of the conductive member 70 in the direction of the axis line L of the bulb 23 is not particularly limited. However, it is preferable that the dimension is set as small as possible within the range where the effect of preventing fluctuations in the contracted discharge can be obtained even if dimming to the dark level is executed. For example, when the shape of the conductive member 70 is a columnar shape, for the size and discharge conditions of a bulb 23 such as is used as the light source in the liquid crystal display back light, the maximum diameter of conductive member 70 is 2 mm.

With regard to the position of the conductive member 70 in the length direction of the bulb 23, for ample, for the size and discharge conditions of the bulb 23 for use as the light source in a liquid crystal display back light, the conductive member 70 is disposed in a position approximately 1 to 10 mm on the center side of the bulb 23 relative to the distal end 24*b* of the internal electrode 24. However, in order to obtain the multiplied effects by applying both the effect of fixing the contracted discharge by the dielectric member 30 and the effect of fixing the contracted discharge by the conductive member 70 to the same discharge space, it is preferable that an image of the conductive member 70 projected onto the external electrode 25 is positioned on the dielectric member 30. Specifically, it is preferable that a proximal end 70*a* and distal end 70*b* of the image of the conductive member 70 projected onto the external electrode 25 be positioned on the dielectric member 30.

Figure 35:
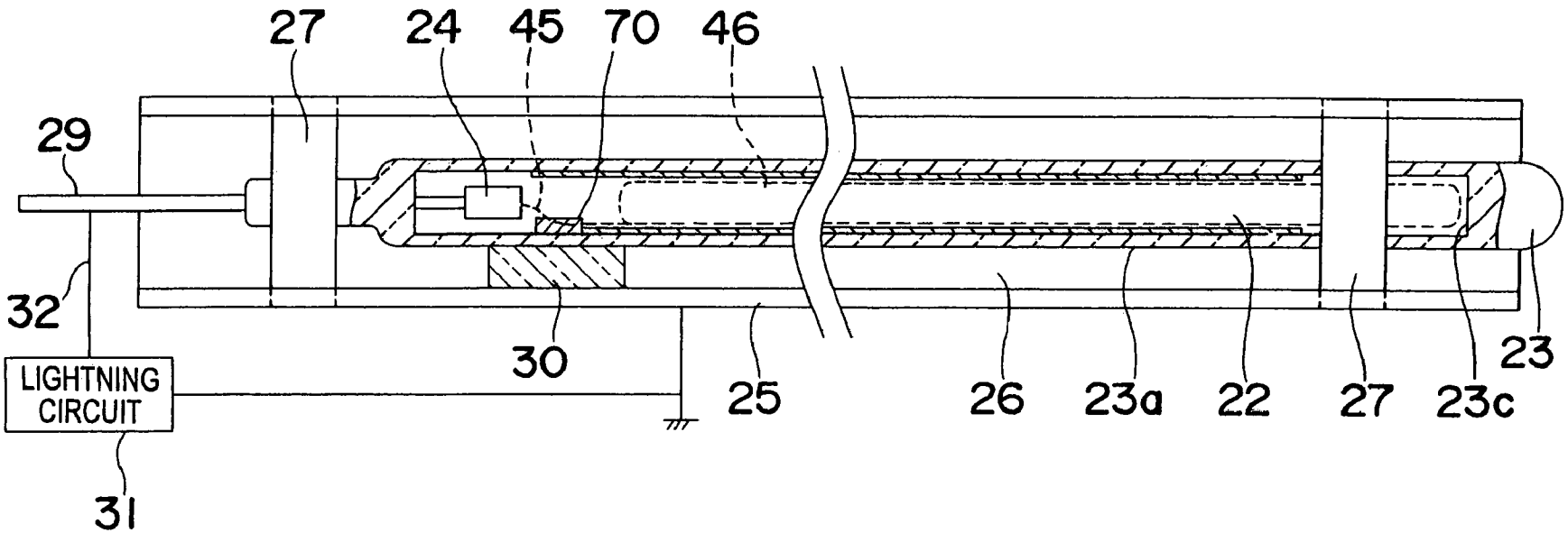
FIG. 35 is a plane view depicting the light source device according to the fourth embodiment schematically depicting discharge inside the bulb.

Referring to FIG. 35, by providing the dielectric member 30, the capacitance of the bulb 23 in the portion along the dielectric member 30 is increased, and the electric field distribution changes. As a result, the contacted discharge 45 is drawn to the vessel wall 23*a* of the bulb 23 at the portion where the dielectric member 30 is provided, and the path of the contracted discharge 45 is fixed. Further, the contracted discharge 45 passes through the conductive member 70. This is inferred to be due to an increase in the permittivity in the portion where the conductive member 70 exists. Thus, in this embodiment, the multiplied effect is obtained from the effect of fixing the contracted discharge 45 by the dielectric member 30 and the effect of fixing the contracted discharge 45 by the conductive member 70. The effect of fixing the contracted discharge 45 by the dielectric member 30 is constrained by the relative permittivity or the capacitance of the dielectric member 30. Further, disposed outside of the bulb 23, the dielectric member 30 cannot dielectric exercise the effect of fixing the contracted discharge 45 in comparison with the dielectric member 30. Therefore, by providing the conductive member 70, more stable fixing of the contracted discharge can be achieved in comparison with a case where only the dielectric member 30 is provided, especially when the dimming to the dark level is executed (for example, with a dimming ratio of not more than 5%).

Since the other arrangements and functions of the second embodiment are the same as those of the first embodiment, the same elements are denoted by the same reference symbols, and descriptions thereof are omitted.

Fifth Experiment Example

Experiments were conducted to confirm the effects of the light source device 21 of the fourth embodiment. Specifically, the flicker was evaluated at the dimming ratios of 20% and 20%.

The bulb 23 had a straight-tube shape with an outer diameter "OD" of 3.0 mm, thickness "tg" of 0.1 mm, and length "γ" of 160 mm. The internal electrode 24 had the cylindrical shape shown in FIG. 6A, of length 4.5 mm and outer diameter 1.85 mm. The bulb 23 was filled with a gas mixture of 60% xenon and 40% argon, sealed at a pressure of 20 kPa. The outer electrode 25 had wall sections 35 to 37 of height 3.6 mm and thickness 0.3 mm.

The dielectric member 30 was made of a silicone resin, of width "α3" 4 mm, length "α1" 12 mm, and thickness "α2" 0.5 mm. The position of the dielectric member 30 in the direction of the axis line L of the bulb 23 was set so that image of the internal electrode 24 projected onto the external electrode 25 overlapped with the dielectric member 30 over a range of 3 mm from the distal end 24*b* side.

The conductive member 70 had Ni as the main component, and was applied in a columnar shape having a diameter of 1 mm onto the inner surface of the vessel wall 23*a* of the bulb 23. The minimum distance from the center position of the conductive member 70 to the internal electrode 24 was 1 mm.

As the dimming conditions, the dimming frequency "fa" was set to 290 Hz. The lighting frequency "fl" was set to 29 kHz. The number of lighting waveforms generated within the on duty interval "Ton" (see FIG. 14) was two for the dimming ratio of 20% and 20 for the dimming ratio of 20%. The peak-to-peak driving voltage Vp-p (see FIG. 15) was 2 kV.

In addition to the light source device 21 (experiment example) of the fourth embodiment as described above, two types of light source devices were prepared as comparison examples. The first comparison example was the light source device 21C, shown in FIG. 20, which does not comprise the dielectric member 30 or the conductive member 70. The second comparison example was the light source device 21A, shown in FIG. 20, comprising the dielectric member 30 but not a conductive member 70. Other arrangements and lighting conditions of the lighting source devices 21C, 21A in the first and second comparison examples were similar to those of the light source device 21 of the experiment example.

Ten light source devices were respectively prepared for the experiment example, a first comparison example, and a second comparison example, and evaluations were performed using two grades consisting of "flicker sensed" and "flicker not sensed". For both of the dimming ratios (20% and 20%) of each of the light source devices, the fraction (percentage) of the number of evaluations that "flicker was sensed" with respect to a total number of evaluation data (ten sets of data) was calculated as an indicator of the subjective evaluation of flicker.

The experimental results are shown in Table 1 below.

TABLE 1

| | Dimming ratio 20% | Dimming ratio 2% |
|---|---|---|
| First Comparison Example | 100% (10/10) | 100% (10/10) |
| Second Comparison Example | 0% (0/10) | 40% (4/10) |
| Experiment Example (Fourth Embodiment) | 0% (0/10) | 0% (0/10) |

As shown in Table 1, using the light source device 21C of the first comparison example, the flicker occurred for all ten bulbs when dimming at both 2% and 20%. Using the light source device 21A of the second comparison example, there was no flicker when dimming at 20%, but dimming occurred for four of ten bulbs when dimming at 20. In contrast, when using the light source device 21 of the experiment example, no flicker occurred for any of the ten bulbs, when dimming at either 2% or at 20%. Thus, by providing the conductive member 70, the flicker is effectively reduced at the dimming ration of 2%.

Fifth Embodiment

Figure 36:
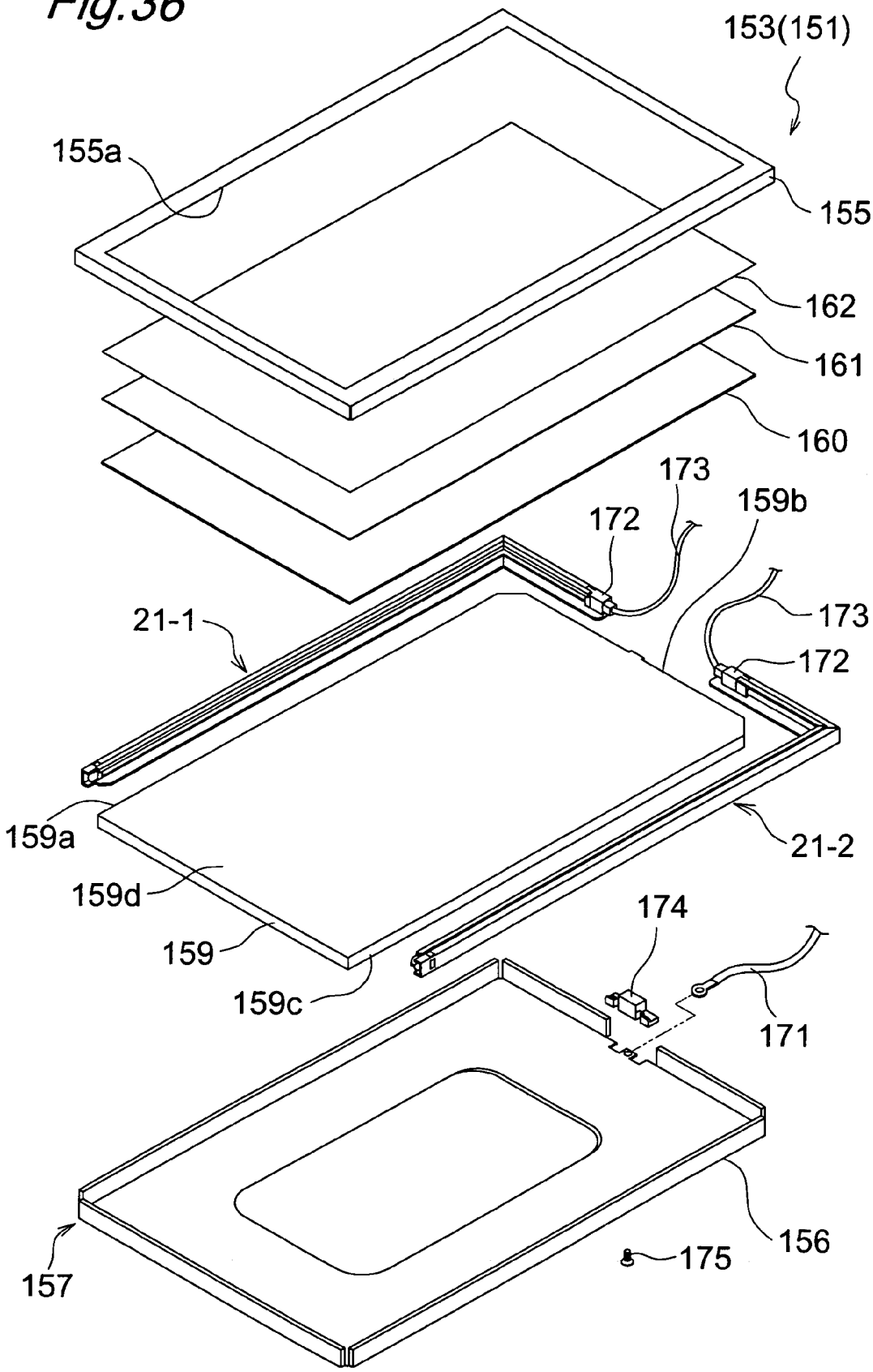
FIG. 36 is an exploded perspective view depicting the liquid crystal display device of a fifth embodiment of the present invention.
Figure 37:
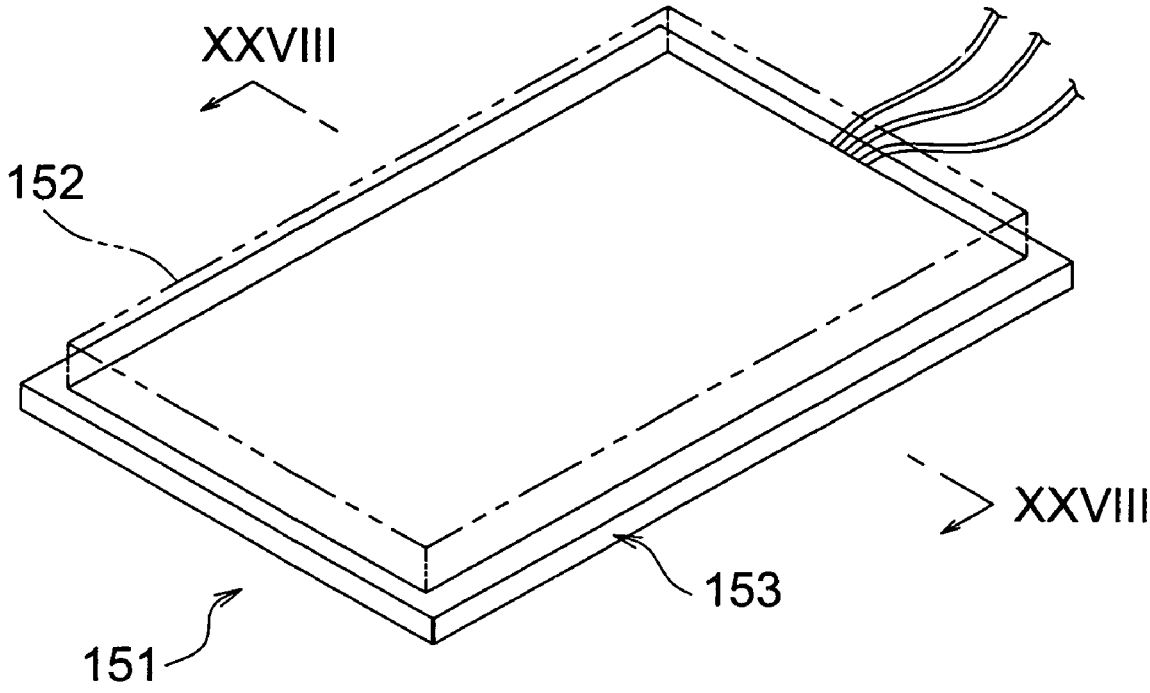
FIG. 37 is a perspective view depicting the liquid crystal device according to the fifth embodiment of the present invention.

A fifth embodiment of the sent invention shown in FIGS. 36 to 37 is an example where the present invention is applied to a liquid crystal display device. Specifically, the liquid crystal display device 51 of the present embodiment comprises a liquid crystal panel 152 shown only in FIG. 22, and a back light device (lighting device) 153. The back light device 153 comprises the light source devices 21-1 and 21-2 according to the first embodiment.

Figure 38:
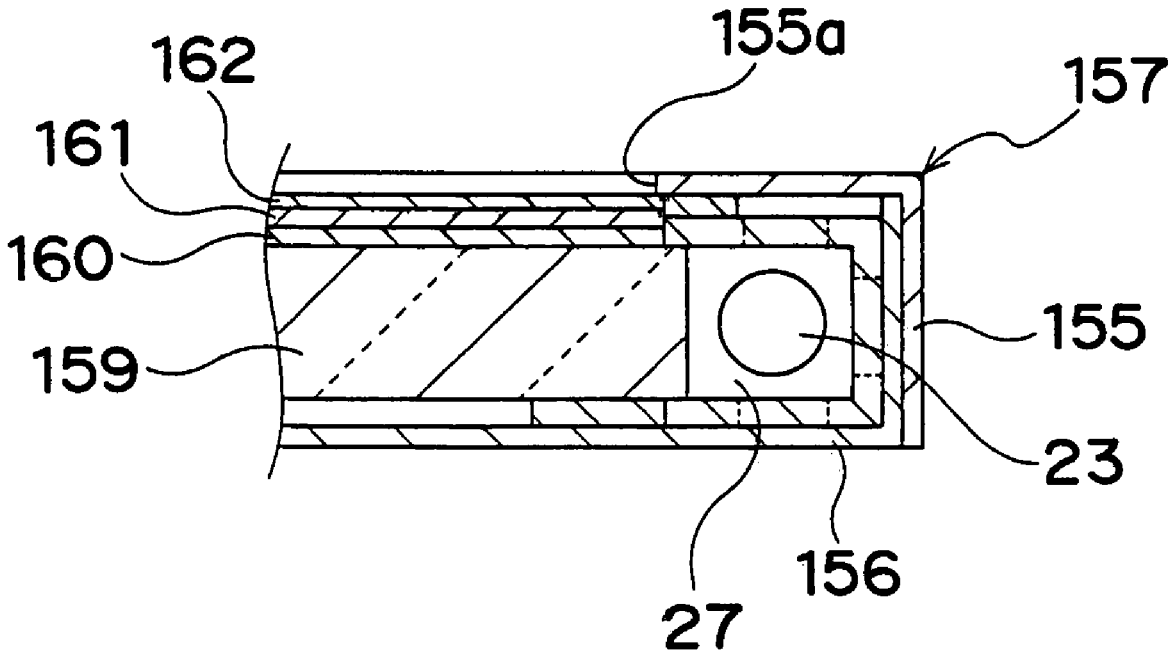
FIG. 38 is a schematic partial cross-sectional view taken along a Line XXVIII-XXXVIII in FIG. 37.

As shown in FIGS. 36 to 38, the back light device 153 comprises a case 157 including a top cover 155 and a back cover 156, which are made of metal. Accommodated in the back cover 156 so as to be layered are a light guide plate 159, light diffusing plate 160, lens plate 161 and polarizing plate 162. Each of the light source device 21-1 and 21-2 has an L-like shape. One light source device 21-1 is disposed so as to be opposed to one end face 159*a* of the light guide plate 159 as well as other end face 159*b* which continues from the end face 159*a*. The other light source device 21-1 is disposed so as to be opposed to the end lace 159*c* that is opposite to the end face 159*a* and the end face 159*b*. Lights emitted from the light source devices 21-1 and 21-1 enter the light guide plate 159 via the end faces 159*a* to 159*c*, and are emitted to a back face of the liquid crystal panel 152 from the emission lace 159*d* of the light guide plate 159 via the light diffusing plate 160, lens plate 161, polarizing plate 162 and opening 155*a* formed in the top cover 155.

Figure 39:
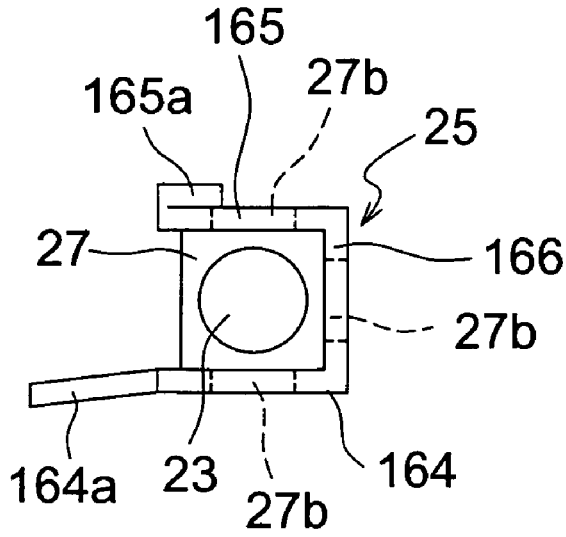
FIG. 39 is a right-side view showing a light source device.
Figure 40:
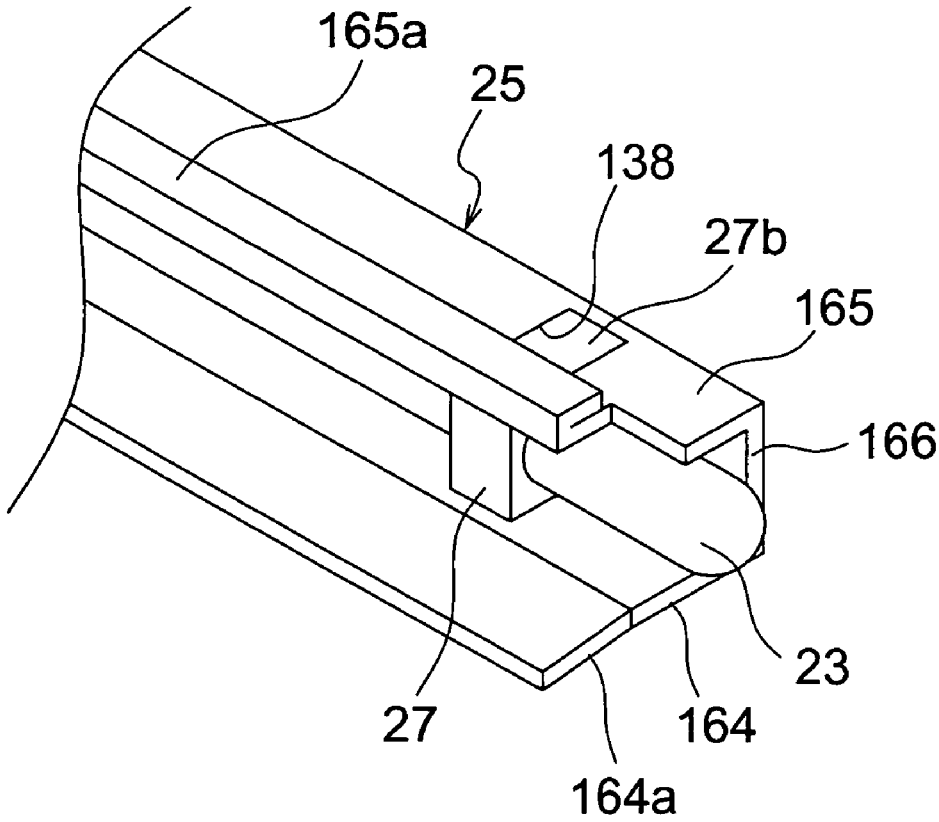
FIG. 40 is a partial enlarged perspective view of the light source device.
Figure 41A:
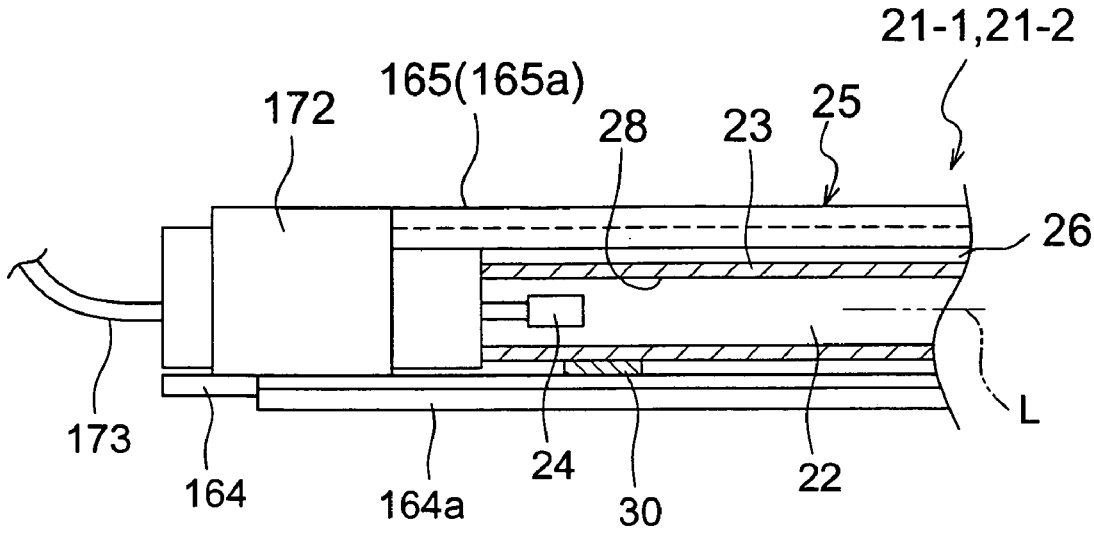
FIG. 41A is a partial enlarged view of the light source device.
Figure 41B:
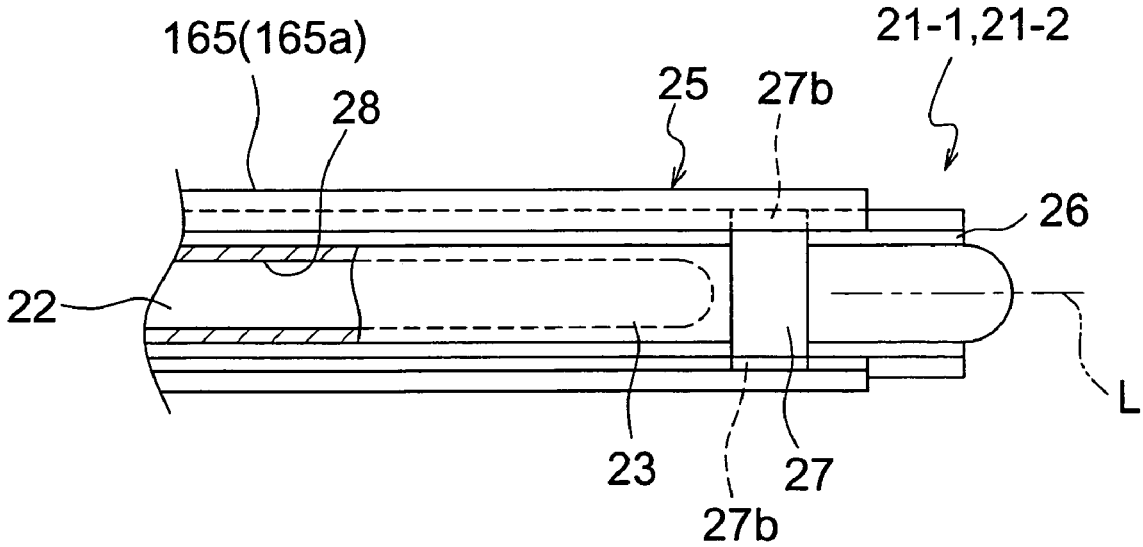
FIG. 41B is a partial enlarged view of the light source device.

As shown in FIGS. 36, 38, and 39, each of the light source devices 21-1 and 21-2 comprises an L shaped bulb 23 inside of which discharge medium containing a rare gas is sealed, an internal electrode 24 is disposed inside the bulb 23, an external electrode 25 is held by a holder member 27 and the latter mentioned connectors 172 are opposed to the bulb 23 with the space 26 therebetween. Further, as shown in FIG. 41, a dielectric member 30 for preventing the flicker is provided. Unless otherwise specified, the dimensions, material and shape of the bulb 23, internal electrode 24, external electrode 25, and the dielectric member of respective light source devices 21-1 and 21-2 are the same as those of the light source device 21 of the first embodiment. The discharge medium as well may be the same as that of the first embodiment.

The external electrode 25 has a U-like cross-sectional shape perpendicular to the axis line L of the bulb 23, which comprises a back wall section 164 at the back cover 156 side, a front wall section 165 at the top cover 155 side, and a side section 166 which links the back wall section 164 and the front wall section 165. An extended section 164*a* is formed at an edge of the back wall section 164, and a fold back section 165*a* is formed at an edge of the front wall section 165. As most clearly shown in FIG. 38, each of the light source devices 21-1 and 21-1 can be supported at an appropriate position with respect to the light guide plate 159 by inserting the light guide plate 159 between the extended section 164*a* of the back wall section 164 and the fold back section 165*a* of the front wall section 165.

The structure and material of the holder member 27 are the same as those of the first embodiment (see FIG. 7). Specifically, the holder member 27 comprises the support hole 27*a* though which the bulb 23 penetrates for being supported and three engagement protrusions 27*b*. At one end of the external electrode 25, an engagement hole 38 is formed in the back wall section 164, front wall section 165 and side wall section 166 respectively, and the external electrode 25 is secured to the holder member 27 by the engagement protrusions 27*b* which fit into these engagement holes 138.

The external electrode 25 is electrically connected to one end of a lead wire 171 via the back cover 156, and the other end of the lead wire 171 is grounded. The primal end side of the rod-like conductive member 129 having the internal electrode 24 at the proximal end is electrically connected to a lead wire 173 inside the connector 172. The connector 172 is attached to the external electrode 25 at the opposite end from the holder member 127, and is made of insulation material. The lead wire 173 is electrical connected to the lighting circuit (not shown). At one edge of the back cover 156, a fixation member 174 made of insulation material is secured by screws 175. Between the fixation member 174 and the back cover 156, a terminal at a tip end of the lead wire 171 for the external electrode 25 is fixed The locking element 174 also has a function of guiding the lead wire 173 at the internal electrode 24 side out of the case 157. The fixation element 174 also has a function of positioning the edges of each light source device 21-1 and 21-1 with respect to the case 157 by engaging the connector 172.

The back light device 153 of the liquid crystal display device 151 of this fifth embodiment may comprise the light source devices 21 of the second through fourth embodiments. Since the other arrangements and functions of the fifth embodiment are the same as those of the first embodiment, the same elements are denoted by the same reference symbols, and descriptions thereof are omitted

Sixth Embodiment

Figure 42B:
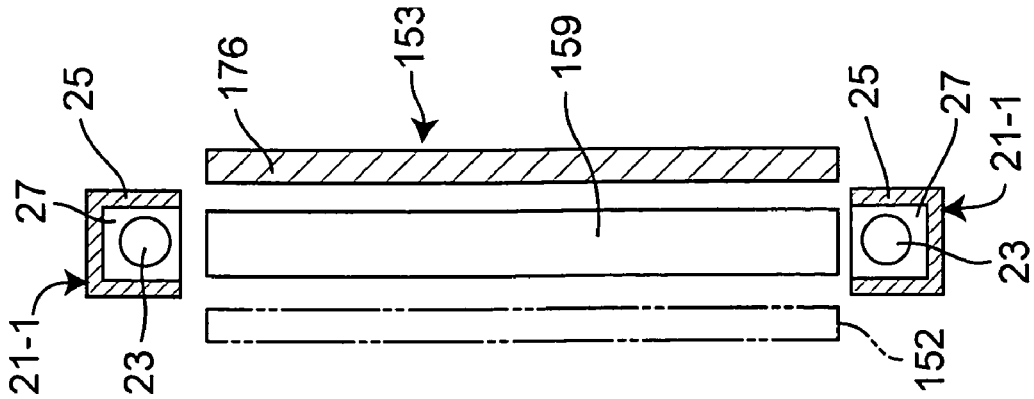
FIG. 42B is a cross-sectional view taken along a line XLII-XLII in FIG. 42A.
Figure 42A:
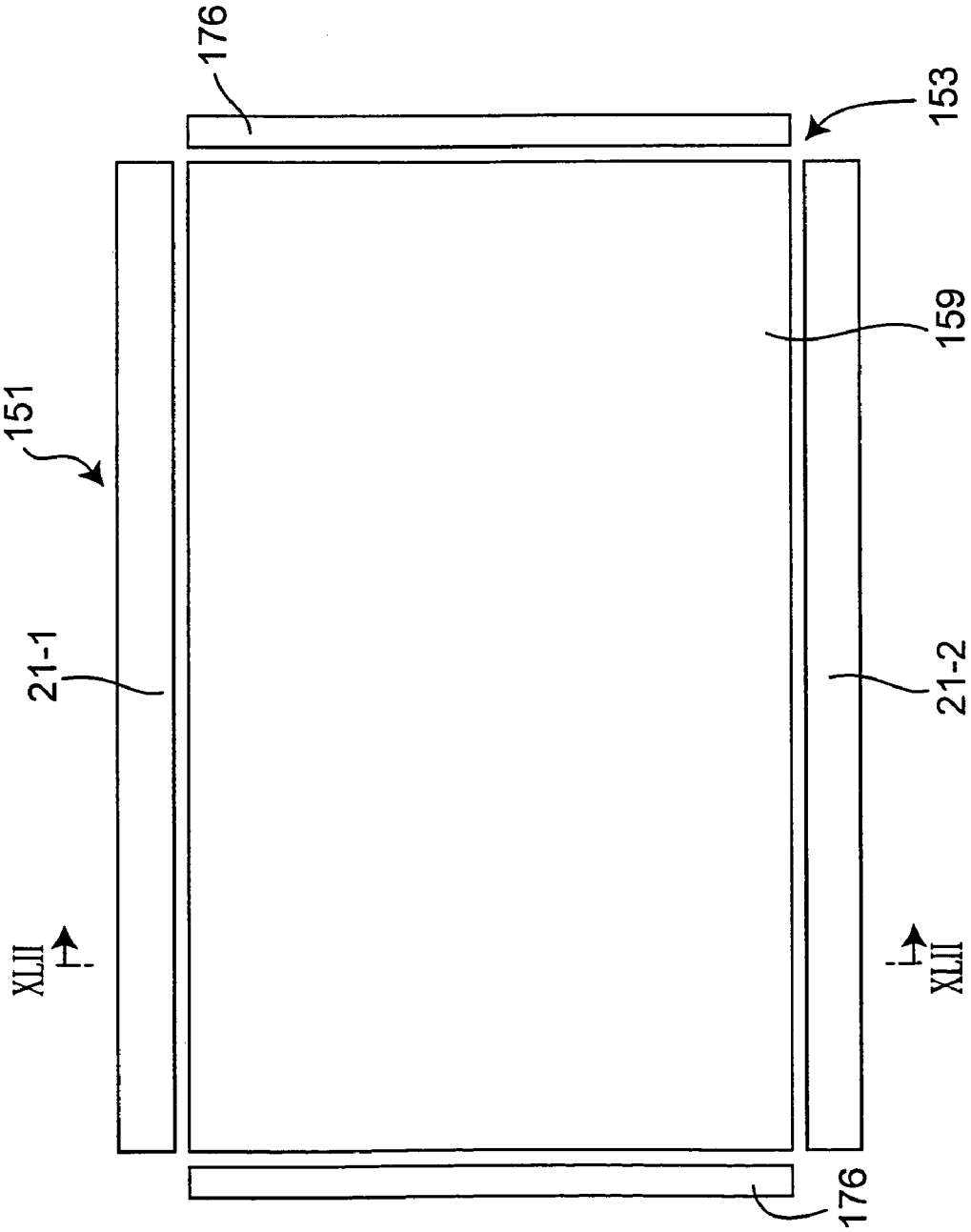
FIG. 42A is a schematic plane view showing the liquid crystal display device according to a sixth embodiment of the invention.
Figure 43:
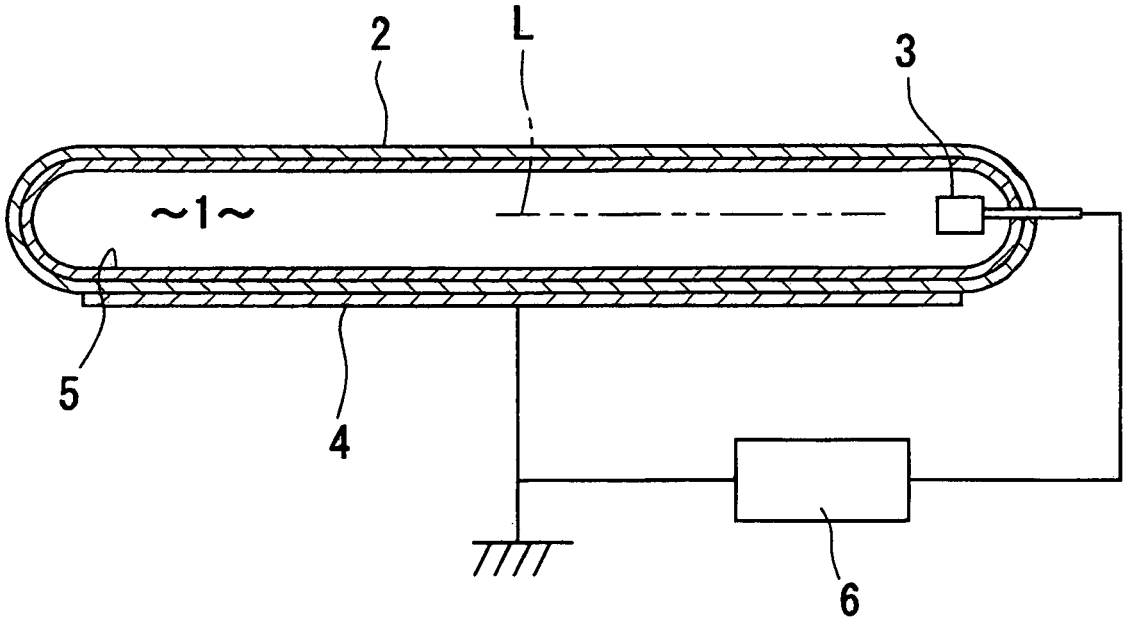
Fig. 43 (PRIOR ART)
FIG. 43 is a schematic cross-sectional view depicting an example of a conventional light source device; and, FIG. 44 is a partial enlarged view of the light source device of FIG. 43.
Figure 44:
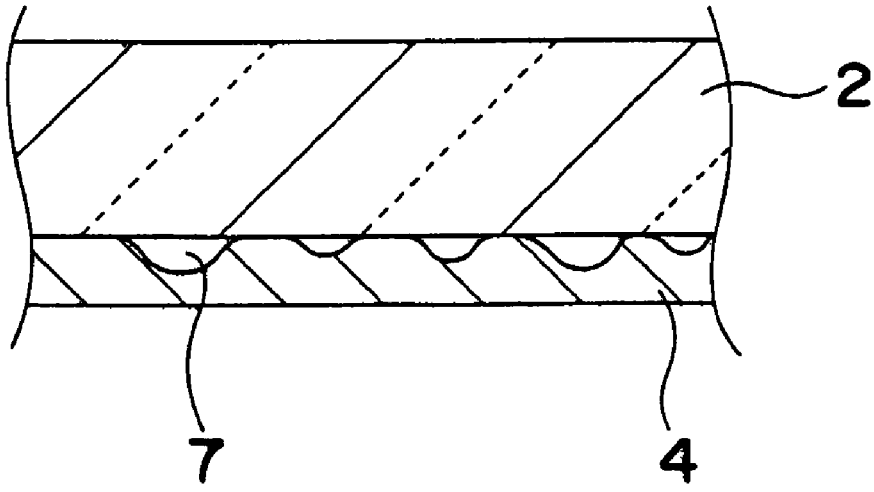
Fig.44 (PRIOR ART)

As schematically shown in FIGS. 42A and 42B, the back light device 153 of the liquid crystal display device 153 according to a sixth embodiment of the present invention comprises a pair of the light source devices 21-1 and 21-2 of the first embodiment each having the straight-tube shape. Reflecting sheets 176 for reflecting light are arranged on two of the six end faces of the light guide plate 159 at which light source devices 21-1 and 21-2 are located, as well as on a bottom face. Although not shown, a diffusing plate, lens plate, polarizing plate, and other members for controlling light distribution may be placed on an emission face of the light guide plate 159.

The back light device 153 of the liquid crystal display device 151 of the sixth embodiment may comprise the light source devices 21 of the second through fourth embodiments. Since the other arrangements and functions of the sixth embodiment are the same as those of the first embodiment, the same elements are denoted by the same reference symbols, and descriptions thereof are omitted.

The light source device of the present invention can be used not only for the back light device of the liquid crystal display device, but also for various light sources such as a light source for general-purpose illuminations, an excimer lamp as a UV light source, and bactericidal lamp.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. A light source device, comprising:

a bulb inside which a discharge medium is sealed;

an internal electrode disposed at an end portion inside the bulb;

an external electrode disposed outside the bulb;

a dielectric member disposed on a first portion of the bulb so as to be interposed between the bulb and the external electrode, the first portion of the bulb being an outside surface of the bulb in the vicinity of the internal electrode; and a holder member holding the external electrode so that a second portion of the bulb and the external electrode are opposed to each other with a predetermined distance of a space therebetween, the second portion being an outside surface of the bulb, wherein the second portion does not overlap the first portion of the bulb.

2. The light source device according to claim 1, wherein the distance of the space between the external electrode and the bulb is not less than a shortest distance defined by the following equation, $$XL = \frac{V}{E0} - \frac{\varepsilon a}{\varepsilon g} \times tg$$

wherein:

XL represents the shortest distance;

EO represents dielectric breakdown voltage;

V represents input voltage;

∈a represents relative permittivity of air;

∈g represents relative permittivity of a vessel wall of the bulb; and tg represents thickness of the vessel wall of the bulb.

3. The light source device according to claim 1, wherein the internal electrode comprises a proximal end positioned on an end portion side of the bulb, and a distal end positioned on a center portion side of the bulb relative to the proximal end, and wherein a dimension of the dielectric member in an elongation direction of the bulb and a position of the dielectric member in the elongation direction of the bulb are set so that a distal end of an image of the internal electrode projected onto the external electrode is positioned on the dielectric member.

4. The light source device according to claim 3, wherein the dielectric member comprises a proximal end positioned on the end portion side of the bulb, and a distal end positioned on the center portion side of the bulb relative to the proximal end, and wherein the proximal end of the dielectric member is positioned on the end portion side of the bulb relative to the distal end of the internal electrode, and the distal end of the dielectric member is positioned on the center portion side of the bulb relative to the distal end of the internal electrode.

5. The light source device according to claim 1, wherein the dielectric member is disposed so as to be in contact with an outer surface of the bulb.

6. The light source device according to claim 1, wherein the dielectric member is disposed so as to be in contact with the external electrode.

7. The light source device according to claim 1, wherein the dielectric member comprises only a dielectric material.

8. The light source device according to claim 7, wherein a relative permittivity of the dielectric material is not less than 4.7.

9. The light source device according to claim 1, wherein the dielectric member comprises a dielectric portion made of a dielectric material, and a conductive portion made of a conductive material.

10. The light source device according to claim 9, wherein the conductive portion is disposed inside the dielectric portion.

11. The light source device according to claim 10, wherein the dielectric portion comprises a first dielectric layer positioned on the side of the bulb and a second dielectric layer positioned on the side of the external electrode, and wherein the conductive portion comprises a conductive layer disposed between the first dielectric layer and the second dielectric layer.

12. The light source device according to claim 11, wherein the conductive layer is a sheet member made of the conductive material.

13. The light source device according to claim 11, wherein the conductive layer is a mesh member made of a conductive material.

14. The light source device according to claim 10, wherein the conductive portion is an elongated member embedded in the dielectric portion.

15. The light source device according to claim 1, further comprising a conductive member disposed within the bulb at a position corresponding to the internal electrode and the dielectric member.

16. The light source device according to claim 15, wherein the conductive member comprises a proximal end positioned on the end portion side of the bulb, and a distal end positioned on the center portion side of the bulb relative to the proximal end portion, and wherein a dimension of the conductive member in an elongated direction of the bulb and a position of the conductive member in the elongation direction of the bulb are set so that a distal end of an image of the conductive member projected onto the external electrode is positioned on the dielectric member.

17. A lighting device, comprising:

the light source device according to claim 1; and, a light guide plate having a light incidence surface and a light emission surface and guiding a light emitted from the light source device from the light incidence face to the light emission face for emission.

18. A liquid crystal display device, comprising:

the light source device according to claim 1;

a light guide plate having a light incidence surface and a light emission surface and guiding a light emitted from the light source device from the light incidence face to the light emission face for emission; and a liquid crystal display panel disposed so as to be opposed to the light emission face of the light guide plate.

* * * * *